US009794686B2

(12) United States Patent
Tammi et al.

(10) Patent No.: US 9,794,686 B2
(45) Date of Patent: Oct. 17, 2017

(54) CONTROLLABLE PLAYBACK SYSTEM OFFERING HIERARCHICAL PLAYBACK OPTIONS

(71) Applicant: Nokia Technologies Oy, Espoo (FI)

(72) Inventors: Mikko T. Tammi, Tampere (FI); Miikka T. Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/674,266

(22) Filed: Mar. 31, 2015

(65) Prior Publication Data

US 2015/0208168 A1 Jul. 23, 2015

Related U.S. Application Data

(63) Continuation of application No. 13/365,468, filed on Feb. 3, 2012, now Pat. No. 9,055,371.

(51) Int. Cl.
*H04R 3/00* (2006.01)
*H04R 1/40* (2006.01)
(Continued)

(52) U.S. Cl.
CPC ..... *H04R 3/005* (2013.01); *H04R 1/406* (2013.01); *H04R 3/12* (2013.01); *H04R 5/027* (2013.01);
(Continued)

(58) Field of Classification Search
CPC ..... H04R 3/005; H04R 1/08; H04R 2201/40; H04R 1/406; H04R 1/12; H04R 3/12
(Continued)

(56) References Cited

U.S. PATENT DOCUMENTS 5,661,808 A 8/1997 Klayman ..... 381/1
6,072,878 A * 6/2000 Moorer ..... H04S 5/005 381/17
(Continued)

FOREIGN PATENT DOCUMENTS

EP 2 154 910 A1 2/2009
JP 2006-180039 7/2006
(Continued)

OTHER PUBLICATIONS

A.K. Tellakula, "Acoustic Source Localization Using Time Delay Estimation", Aug. 2007, whole document (76 pages),, Supercomputer Education and Research Center—Indian Institute of Science, Bangalore, India.
(Continued)

*Primary Examiner* — Disler Paul
(74) *Attorney, Agent, or Firm* — Harrington & Smith

(57) ABSTRACT

A first apparatus performs the following: determining, using microphone signals corresponding to a left microphone signal from a left microphone and a right microphone signal from a right microphone and using at least one further microphone signal, directional information of the left and right microphone signals corresponding to a location of a sound source; outputting a first signal corresponding to the left microphone signal; outputting a second signal corresponding to the right microphone signal; and outputting a third signal corresponding to the determined directional information. A second apparatus performs the following: determining, using microphone signals corresponding to a left microphone signal from a left microphone and a right microphone signal from a right microphone and using at least one further microphone signal, directional information of the left and right microphone signals corresponding to a location of a sound source; converting the left microphone signal, the right microphone signal and the directional information into a high quality left microphone signal and a high quality right microphone signal; and outputting a first signal corresponding to the high quality left microphone signal; and outputting a second signal corresponding to the high quality right microphone signal. Additional apparatus, program products, and methods are disclosed.

20 Claims, 18 Drawing Sheets

(51) Int. Cl.
*H04R 3/12* (2006.01)
*H04R 5/027* (2006.01)
*H04R 5/04* (2006.01)

(52) U.S. Cl.
CPC ..... *H04R 5/04* (2013.01); *H04R 2201/40* (2013.01); *H04S 2420/01* (2013.01)

(58) Field of Classification Search
USPC ..... 381/91–92, 22–23, 74, 309–310
See application file for complete search history.

(56) References Cited

U.S. PATENT DOCUMENTS

| | | | | |
|---|---|---|---|---|
| 6,904,152 | B1 * | 6/2005 | Moorer | H04S 5/005 381/17 |
| 7,706,543 | B2 | 4/2010 | Daniel | 381/17 |
| 8,023,660 | B2 | 9/2011 | Faller | 381/23 |
| 8,081,773 | B2 * | 12/2011 | Daishin | H04R 5/027 381/26 |
| 8,280,077 | B2 | 10/2012 | Avendano et al. | 381/99 |
| 8,335,321 | B2 * | 12/2012 | Daishin | H04R 5/027 381/26 |
| RE44,611 | E | 11/2013 | Metcalf | 381/17 |
| 8,600,530 | B2 | 12/2013 | Nagle et al. | 700/94 |
| 2003/0161479 | A1 | 8/2003 | Yang et al. | 381/22 |
| 2005/0008170 | A1 * | 1/2005 | Pfaffinger | H04S 7/30 381/96 |
| 2005/0195990 | A1 | 9/2005 | Kondo et al. | 381/92 |
| 2005/0244023 | A1 | 11/2005 | Roeck et al. | 381/321 |
| 2008/0013751 | A1 | 1/2008 | Hiselius | 381/102 |
| 2008/0232601 | A1 | 9/2008 | Pulkki | 381/1 |
| 2009/0012779 | A1 | 1/2009 | Ikeda et al. | 704/205 |
| 2009/0022328 | A1 | 1/2009 | Neugebauer et al. | 381/27 |
| 2010/0061558 | A1 | 3/2010 | Faller | 381/23 |
| 2010/0150364 | A1 | 6/2010 | Buck et al. | 381/66 |
| 2010/0166191 | A1 | 7/2010 | Herre et al. | 381/1 |
| 2010/0215199 | A1 | 8/2010 | Breebaart | 381/310 |
| 2010/0284551 | A1 | 11/2010 | Ch et al. | 381/119 |
| 2010/0290629 | A1 | 11/2010 | Morii | 381/2 |
| 2011/0038485 | A1 | 2/2011 | Neoran et al. | 381/27 |
| 2011/0081024 | A1 * | 4/2011 | Soulodre | G01S 3/8006 381/17 |
| 2011/0299702 | A1 | 12/2011 | Faller | 381/92 |
| 2012/0001969 | A1 | 1/2012 | Zurek et al. | 348/240.99 |
| 2012/0013768 | A1 | 1/2012 | Zurek et al. | 348/231.4 |

FOREIGN PATENT DOCUMENTS

| | | | |
|---|---|---|---|
| JP | 2009271183 | A | 11/2009 |
| WO | WO-2007011157 | A1 | 1/2007 |
| WO | WO-2008/046531 | A1 | 4/2008 |
| WO | WO-2009/150288 | A1 | 12/2009 |
| WO | WO-2010017833 | A1 | 2/2010 |
| WO | WO-2010/028784 | A1 | 3/2010 |
| WO | WO-2010/125228 | A1 | 11/2010 |

OTHER PUBLICATIONS

Knapp, "The Generalized Correlation Method for Estimation of Time Delay", Aug. 1976, pp. 320-327.
A. D. Blumlein, U.K. patent 394,325, 1931. Reprinted in Stereophonic Techniques (Audio Engineering Society, New York, 1986).
V. Pulkki, "Virtual Sound Source Positioning Using Vector Base Amplitude Panning," J. Audio Eng. Soc., vol. 45, pp. 456-466 (Jun. 1997).
Tammi et al., *Converting Multi-Microphone Captured Signals to Shifted Signals Useful for Binaural Signal Processing and Use Thereof*, U.S. Appl. No. 12/927,663, filed Nov. 19, 2010.
Tammi et al., *Apparatus and Method for Multi-Channel Signal Playback*, U.S. Appl. No. 13/209,738, filed Aug. 15, 2011.
Lindblom, Jonas et al., "Flexible Sum-Difference Stereo Coding Based on Time-Aligned Signal Components", IEEE, Oct. 2005, pp. 255-258.
Pulkki, V., et al., "Directional audio coding-perception-based reproduction of spatial sound", IWPASH, Nov. 2009, 4 pgs.
Tamai, Yuki et al., "Real-Time 2 Dimensional Sound Source Localization by 128-Channel Hugh Microphone Array", IEEE, 2004, pp. 65-70.
Nakadai, Kazuhiro, et al., "Sound Source Tracking with Directivity Pattern Estimation Using a 64 ch Microphone Array", 7 pgs.
Baumgarte, Frank, et al., "Binaural Cue Coding—Part I: Psychoacoustic Fundamentals and Design Principles", IEEE 2003, pp. 509-519.
Laitinen, Mikko-Ville, et al., "Binaural Reproduction for Directional Audio Coding", IEEE, Oct. 2009, pp. 337-340.
Kallinger, Markus, et al., "Enhanced Direction Estimation Using Microphone Arrays for Directional Audio Coding", IEEE, 2008, pp. 45-48.
Gallo, Emmanuel, et al., "Extracting and Re-rendering Structured Auditory Scenes from Field Recordings", AES 30$^{th}$ International Conference, Mar. 2007, 11 pgs.
Gerzon, Michael A., "Ambisonics in Multichannel Broadcasting and Video", AES, Oct. 1983, 31 pgs.
Pulkki, Ville, "Spatial Sound Reproduction with Directional Audio Coding", J. Audio Eng. Soc., vol. 55 No. 6, Jun. 2007, pp. 503-516.
Faller, Christof, et al., "Binaural Cue Coding—Part II: Schemes and Applications", IEEE, Nov. 2003, pp. 520-531.
Merimaa, Juha, "Applications of a 3-D Microphone Array", AES 112$^{th}$ Convention, Convention Paper 5501, May 2002, 11 pgs.
Backman, Juha, "Microphone array beam forming for multichannel recording", AES 114$^{th}$ Convention, Convention Paper 5721, Mar. 2003, 7 pgs.
Meyer, Jens, et al., "Spherical microphone array for spatial sound recording", AES 115$^{th}$ Convention, Convention Paper 5975, Oct. 2003, 9 pgs.
Ahonen, Jukka, et al., "Directional analysis of sound field with linear microphone array and applications in sound reproduction", AES 124$^{th}$ Convention, Convention Paper 7329, May 2008, 11 pgs.
Wiggins, Bruce, "An Investigation Into the Real-Time Manipulation and Control of Three-Dimensional Sound Fields", University of Derby, 2004, 348 pgs.
Peter G. Craven, "Continuous Surround Panning for 5-Speaker Reproduction", Continuous Surround Panning, AES 24$^{th}$ International Conferences on Multichannel Audio Jun. 2003.
Aarts, Ronald M. and Irwan, Roy, "A Method to Convert Stereo to Multi-Channel Sound", Audio Engineering Society Conference Paper, Presented at the 19$^{th}$ International Conference Jun. 21-24, 2001; Schloss Elmau, Germany.
Goodwin, Michael M. and Jot, Jean-Marc, "Binaural 3-D Audio Rendering based on Spatial Audio Scene Coding", Audio Engineering Society Convention paper 7277, Presented at the 123$^{rd}$ Convention, Oct. 5-8, 2007 New York, NY.
Brebaart, J. et al.; "Multi-Channel Goes Mobile: MPEG Surround Binaural Rendering"; AES International Conference, Audio for Mobile and Handheld Devices; Sep. 2, 2006; pp. 1-13.

* cited by examiner

CONTROLLABLE PLAYBACK SYSTEM OFFERING HIERARCHICAL PLAYBACK OPTIONS

CROSS-REFERENCE TO RELATED APPLICATIONS

The instant application is a continuation application of Ser. No. 13/365,468, filed on 3 Feb. 2012, entitled "A Controllable Playback System Offering Hierarchical Playback Options", by the same inventors (Mikko T. Tammi and Miikka T. Vilermo) as the instant application; and is related to Ser. No. 12/927,663, filed on 19 Nov. 2010, entitled "Converting Multi-Microphone Captured Signals to Shifted Signals Useful for Binaural Signal Processing And Use Thereof", by the same inventors (Mikko T. Tammi and Miikka T. Vilermo) as the instant application; and Ser. No. 13/209,738, filed on 15 Aug. 2011, entitled "Apparatus and Method for Multi-Channel Signal Playback", by the same inventors (Mikko T. Tammi and Miikka T. Vilermo) as the instant application; each of these applications is incorporated by reference herein in its entirety.

TECHNICAL FIELD

This invention relates generally to microphone recording and signal playback based thereon and, more specifically, relates to processing multi-microphone captured signals, and playback of the multi-microphone signals.

BACKGROUND

This section is intended to provide a background or context to the invention that is recited in the claims. The description herein may include concepts that could be pursued, but are not necessarily ones that have been previously conceived, implemented or described. Therefore, unless otherwise indicated herein, what is described in this section is not prior art to the description and claims in this application and is not admitted to be prior art by inclusion in this section.

Multiple microphones can be used to capture efficiently audio events. However, often it is difficult to convert the captured signals into a form such that the listener can experience the event as if being present in the situation in which the signal was recorded. Particularly, the spatial representation tends to be lacking, i.e., the listener does not sense the directions of the sound sources, as well as the ambience around the listener, identically as if he or she was in the original event.

Binaural recordings, recorded typically with an artificial head with microphones in the ears, are an efficient method for capturing audio events. By using stereo headphones the listener can (almost) authentically experience the original event upon playback of binaural recordings. Unfortunately, in many situations it is not possible to use the artificial head for recordings. However, multiple separate microphones can be used to provide a reasonable facsimile of true binaural recordings.

Even with the use of multiple separate microphones, a problem is converting the capture of multiple (e.g., omnidirectional) microphones in known locations into good quality signals that retain the original spatial representation and can be used as binaural signals, i.e., providing equal or near-equal quality as if the signals were recorded with an artificial head.

Furthermore, in addition to binaural output (typically output through headphones), many home systems are able to output over, e.g., five or more speakers. Since many users have mobile devices through which they can capture audio and video (with audio too), these users may desire the option to output sound recorded by multiple microphones on the mobile devices to systems with multi-channel (typically five or more) outputs and corresponding speakers. Still further, a user may desire to use two channel (e.g., stereo) output, since many speaker systems still use two channels.

Thus, a user may wish to play the same captured audio using stereo outputs, binaural outputs, or multi-channel outputs.

SUMMARY

This section is meant to provide an exemplary overview of exemplary embodiments of the instant invention.

In accordance with a non-limiting exemplary embodiment, directional information is determined using microphone signals corresponding to a left microphone signal from a left microphone and a right microphone signal from a right microphone and using at least one further microphone signal. The directional information of the left and right microphone signals corresponds to a location of a sound source. A first signal is outputted corresponding to the left microphone signal, and a second signal is outputted corresponding to the right microphone signal. A third signal is outputted corresponding to the determined directional information.

In accordance with another non-limiting exemplary embodiment, a first signal is received corresponding to a left microphone signal from a left microphone. A second signal is received corresponding to a right microphone signal from a right microphone. A third signal is received corresponding to a sign of directional information of the left and right microphone signals. The directional information is determined using at least one further microphone signal and corresponds to a location of a sound source.

In accordance with another non-limiting exemplary embodiment, directional information is determined using microphone signals corresponding to a left microphone signal from a left microphone and a right microphone signal from a right microphone, and using at least one further microphone signal. The directional information of the left and right microphone signals correspond to a location of a sound source. The left microphone signal, the right microphone signal and the directional information are converted into a high quality left microphone signal and a high quality right microphone signal. A first signal is outputted corresponding to the high quality left microphone signal, and a second signal is outputted corresponding to the high quality right microphone signal.

In accordance with another non-limiting exemplary embodiment, a first signal is received corresponding to a high quality left microphone signal determined from a left microphone. A second signal is received corresponding to a high quality right microphone signal determined from a right microphone. The high quality left microphone signal and the high quality right microphone signal are based on directional information of left and right microphone signals determined using at least one further microphone signal and corresponding to a location of a sound source.

BRIEF DESCRIPTION OF THE DRAWINGS

The foregoing and other aspects of embodiments of this invention are made more evident in the following Detailed Description of Exemplary Embodiments, when read in conjunction with the attached Drawing Figures, wherein.

DETAILED DESCRIPTION OF THE DRAWINGS

Figure 1:
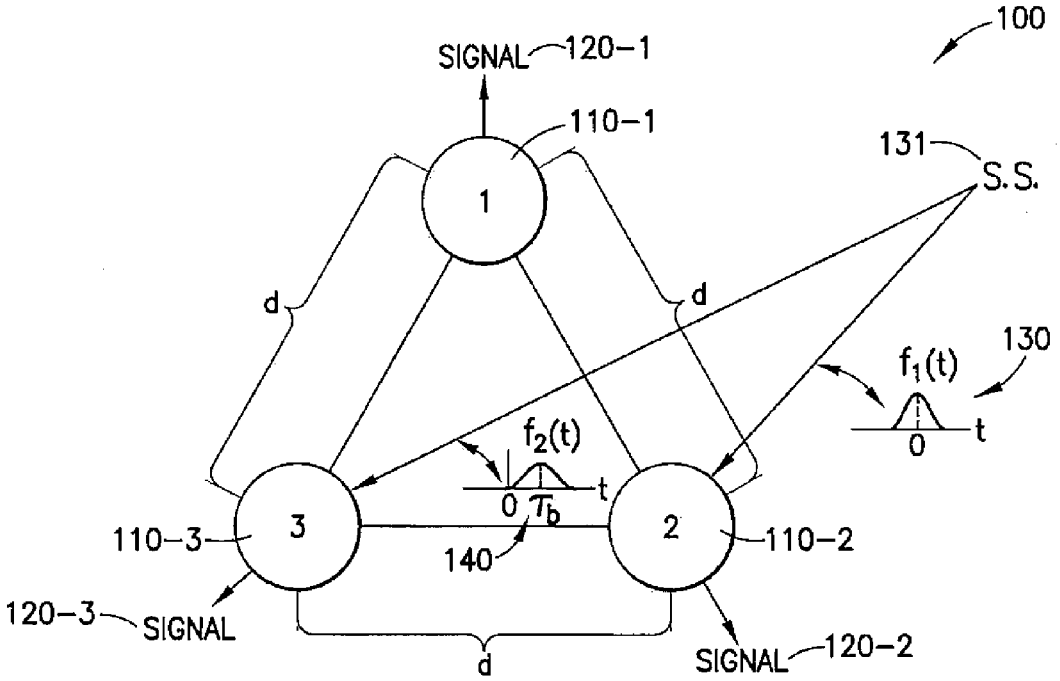
FIG. 1 shows an exemplary microphone setup using omnidirectional microphones.

As stated above, multiple separate microphones can be used to provide a reasonable facsimile of true binaural recordings. In recording studio and similar conditions, the microphones are typically of high quality and placed at particular predetermined locations. However, it is reasonable to apply multiple separate microphones for recording to less controlled situations. For instance, in such situations, the microphones can be located in different positions depending on the application:

1) In the corners of a mobile device such as a mobile phone, although the microphones do not have to be in the corners of the device, just in general around the device;

2) In a headband or other similar wearable solution that is connected to a mobile device;

3) In a separate device that is connected to a mobile device or computer;

4) In separate mobile devices, in which case actual processing occurs in one of the devices or in a separate server; or 5) With a fixed microphone setup, for example, in a teleconference room, connected to a phone or computer.

Furthermore, there are several possibilities to exploit spatial sound recordings in different applications:

- Binaural audio enables mobile "3D" phone calls, i.e., "feel-what-I-feel" type of applications. This provides the listener a much stronger experience of "being there". This is a desirable feature with family members or friends when one wants to share important moments as make these moments as realistic as possible.
- Binaural audio can be combined with video, and currently with three-dimensional (3D) video recorded, e.g., by a consumer. This provides a more immersive experience to consumers, regardless of whether the audio/video is real-time or recorded.
- Teleconferencing applications can be made much more natural with binaural sound. Hearing the speakers in different directions makes it easier to differentiate speakers and it is also possible to concentrate on one speaker even though there would be several simultaneous speakers.
- Spatial audio signals can be utilized also in head tracking. For instance, on the recording end, the directional changes in the recording device can be detected (and removed if desired). Alternatively, on the listening end, the movements of the listener's head can be compensated such that the sounds appear, regardless of head movement, to arrive from the same direction.

As stated above, even with the use of multiple separate microphones, a problem is converting the capture of multiple (e.g., omnidirectional) microphones in known locations into good quality signals that retain the original spatial representation. This is especially true for good quality signals that may also be used as binaural signals, i.e., providing equal or near-equal quality as if the signals were recorded with an artificial head. Exemplary embodiments herein provide techniques for converting the capture of multiple (e.g., omnidirectional) microphones in known locations into signals that retain the original spatial representation. Techniques are also provided herein for modifying the signals into binaural signals, to provide equal or near-equal quality as if the signals were recorded with an artificial head.

The following techniques mainly refer to a system 100 with three microphones 100-1, 100-2, and 100-3 on a plane (e.g., horizontal level) in the geometrical shape of a triangle with vertices separated by distance, d, as illustrated in FIG. 1. However, the techniques can be easily generalized to different microphone setups and geometry. Typically, all the microphones are able to capture sound events from all directions, i.e., the microphones are omnidirectional. Each microphone 100 produces a typically analog signal 120.

The value of a 3D surround audio system can be measured using several different criteria. The most import criteria are the following:

1. Recording flexibility. The number of microphones needed, the price of the microphones (omnidirectional microphones are the cheapest), the size of the microphones (omnidirectional microphones are the smallest), and the flexibility in placing the microphones (large microphone arrays where the microphones have to be in a certain position in relation to other microphones are difficult to place on, e.g., a mobile device).

2. Number of channels. The number of channels needed for transmitting the captured signal to a receiver while retaining the ability for head tracking (if head tracking is possible for the given system in general): A high number of channels takes too many bits to transmit the audio signal over networks such as mobile networks.

3. Rendering flexibility. For the best user experience, the same audio signal should be able to be played over various different speaker setups: mono or stereo from the speakers of, e.g., a mobile phone or home stereos; 5.1 channels from a home theater; stereo using headphones, etc. Also, for the best 3D headphone experience, head tracking should be possible.

4. Audio quality. Both pleasantness and accuracy (e.g., the ability to localize sound sources) are important in 3D surround audio. Pleasantness is more important for commercial applications.

With regard to this criteria, exemplary embodiments of the instant invention provide the following:

1. Recording flexibility. Only omnidirectional microphones need be used. Only three microphones are needed. Microphones can be placed in any configuration (although the configuration shown in FIG. 1 is used in the examples below).

2. Number of channels needed. Two channels are used for higher quality. One channel may be used for medium quality.

3. Rendering flexibility. This disclosure describes only binaural rendering, but all other loudspeaker setups are possible, as well as head tracking.

4. Audio quality. In tests, the quality is very close to original binaural recordings and High Quality DirAC (directional audio coding).

In the instant invention, the directional component of sound from several microphones is enhanced by removing time differences in each frequency band of the microphone signals. In this way, a downmix from the microphone signals will be more coherent. A more coherent downmix makes it possible to render the sound with a higher quality in the receiving end (i.e., the playing end).

In an exemplary embodiment, the directional component may be enhanced and an ambience component created by using mid/side decomposition. The mid-signal is a downmix of two channels. It will be more coherent with a stronger directional component when time difference removal is used. The stronger the directional component is in the mid-signal, the weaker the directional component is in the side-signal. This makes the side-signal a better representation of the ambience component.

This description is divided into several parts. In the first part, the estimation of the directional information is briefly described. In the second part, it is described how the directional information is used for generating binaural signals from three microphone capture. Yet additional parts describe apparatus and encoding/decoding.

Directional Analysis

There are many alternative methods regarding how to estimate the direction of arriving sound. In this section, one method is described to determine the directional information. This method has been found to be efficient. This method is merely exemplary and other methods may be used. This method is described using FIGS. 2 and 3. It is noted that the flowcharts for FIGS. 2 and 3 (and all other figures having flowcharts) may be performed by software executed by one or more processors, hardware elements (such as integrated circuits) designed to incorporate and perform one or more of the operations in the flowcharts, or some combination of these.

A straightforward direction analysis method, which is directly based on correlation between channels, is now described. The direction of arriving sound is estimated independently for B frequency domain subbands. The idea is to find the direction of the perceptually dominating sound source for every subband.

Figure 2:
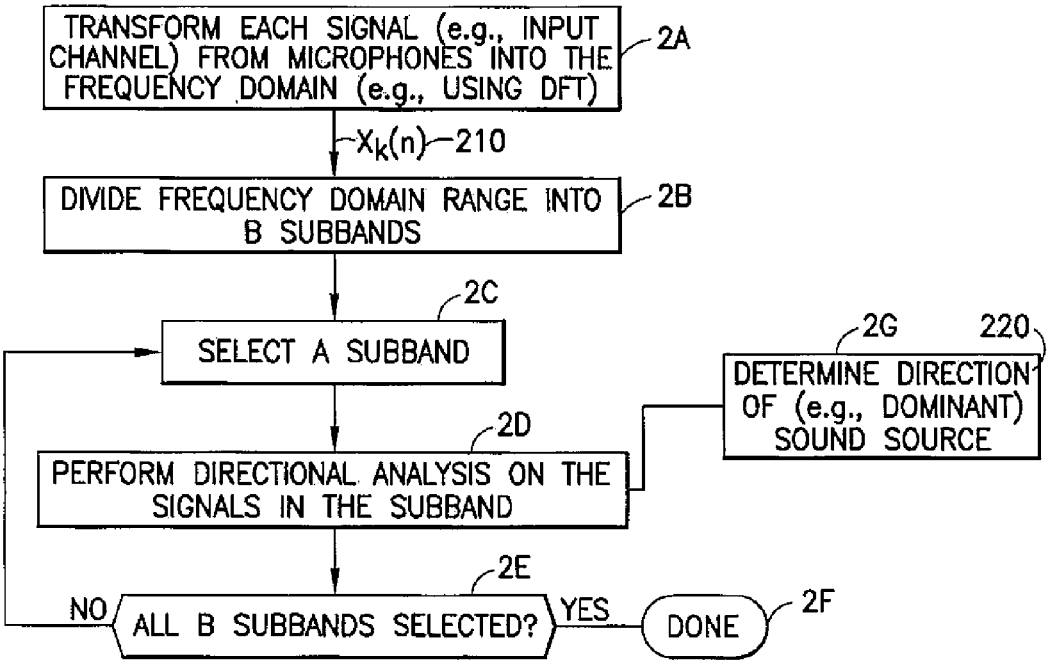
FIG. 2 is a block diagram of a flowchart for performing a directional analysis on microphone signals from multiple microphones.
Figure 3:
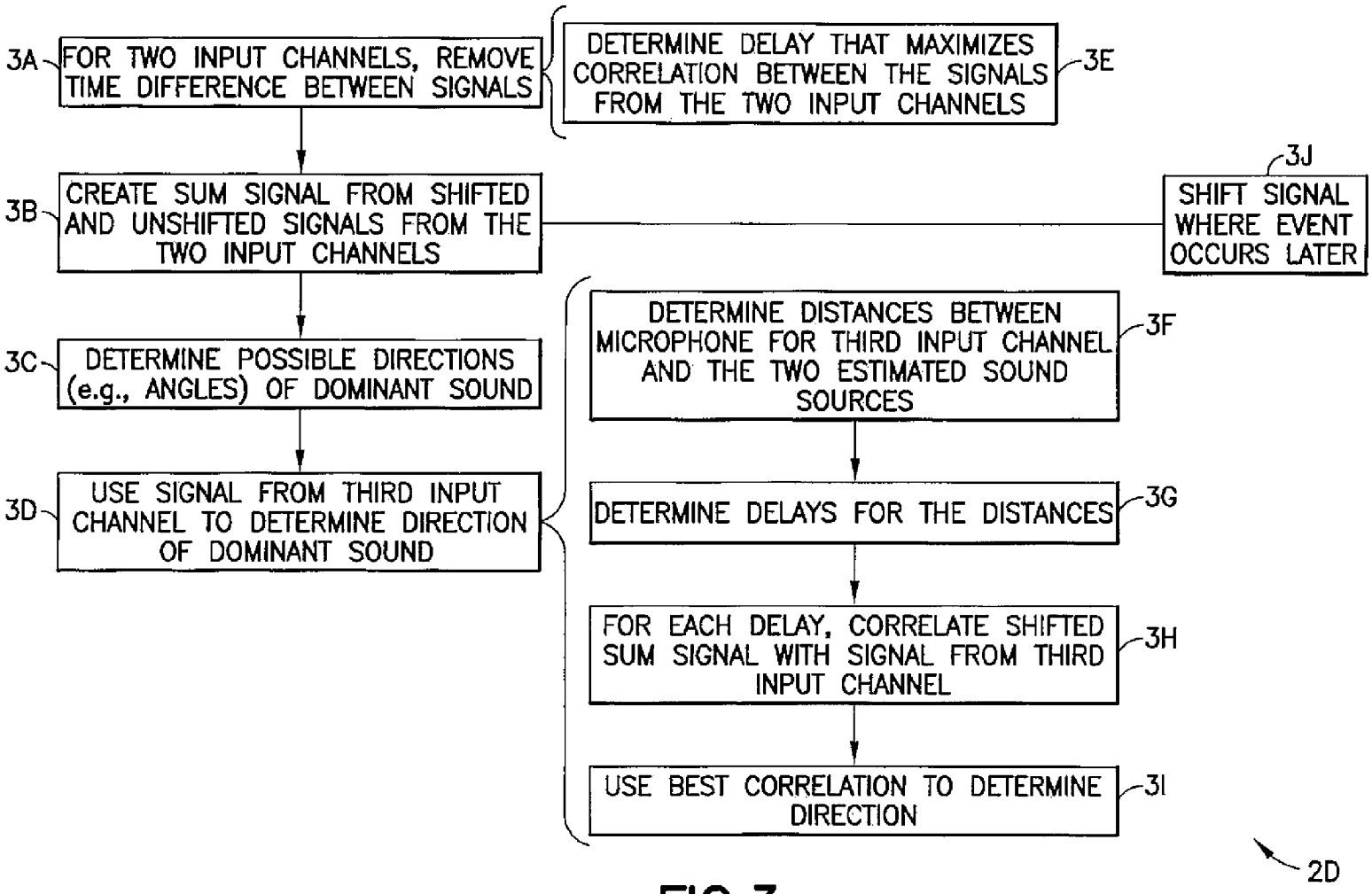
FIG. 3 is a block diagram of a flowchart for performing directional analysis on subbands for frequency-domain microphone signals.

Every input channel k=1, 2, 3 is transformed to the frequency domain using the DFT (discrete Fourier transform) (block 2A of FIG. 2). Each input channel corresponds to a signal 120-1, 120-2, 120-3 produced by a corresponding microphone 110-1, 110-2, 110-3 and is a digital version (e.g., sampled version) of the analog signal 120. In an exemplary embodiment, sinusoidal windows with 50 percent overlap and effective length of 20 ms (milliseconds) are used. Before the DFT transform is used, $D_{tot}=D_{max}+D_{HRTF}$ zeroes are added to the end of the window. $D_{max}$ corresponds to the maximum delay in samples between the microphones. In the microphone setup presented in FIG. 1, the maximum delay is obtained as $$D_{max} = \frac{dF_S}{v}, \tag{1}$$

where $F_S$ is the sampling rate of signal and ν is the speed of the sound in the air. $D_{HRTF}$ is the maximum delay caused to the signal by HRTF (head related transfer functions) processing. The motivation for these additional zeroes is given later. After the DFT transform, the frequency domain representation $X_k$ (n) (reference 210 in FIG. 2) results for all three channels, k=1, . . . 3, n=0, . . . , N−1. N is the total length of the window considering the sinusoidal window (length $N_s$) and the additional $D_{tot}$ zeroes.

The frequency domain representation is divided into B subbands (block 2B)

$$X_k^b(n)=X_k(n_b+n), n=0, \ldots, n_{b+1}-n_b-1, \quad b=0, \ldots, B-1, \tag{2}$$

where $n_b$ is the first index of bth subband. The widths of the subbands can follow, for example, the ERB (equivalent rectangular bandwidth) scale.

For every subband, the directional analysis is performed as follows. In block 2C, a subband is selected. In block 2D, directional analysis is performed on the signals in the subband. Such a directional analysis determines a direction 220 ($\alpha_b$ below) of the (e.g., dominant) sound source (block 2G). Block 2D is described in more detail in FIG. 3. In block 2E, it is determined if all subbands have been selected. If not (block 2B=NO), the flowchart continues in block 2C. If so (block 2E=YES), the flowchart ends in block 2F.

More specifically, the directional analysis is performed as follows. First the direction is estimated with two input channels (in the example implementation, input channels 2 and 3). For the two input channels, the time difference between the frequency-domain signals in those channels is removed (block 3A of FIG. 3). The task is to find delay $\tau_b$ that maximizes the correlation between two channels for subband b (block 3E). The frequency domain representation of, e.g., $X_k^b(n)$ can be shifted $\tau_b$ time domain samples using $$X_{k,\tau_b}^b(n) = X_k^b(n)e^{-j\frac{2\pi n\tau_b}{N}}. \tag{3}$$

Now the optimal delay is obtained (block 3E) from $$\max_{\tau_b} Re(\Sigma_{n=0}^{n_{b+1}-n_b-1}(X_{2,\tau_b}^b(n)*X_3^b(n))), \tau_b \epsilon [-D_{max}, D_{max}] \tag{4}$$

where Re indicates the real part of the result and * denotes complex conjugate. $X_{2,\tau_b}^b$ and $X_3^b$ are considered vectors with length of $n_{b+1}-n_b$ samples. Resolution of one sample is generally suitable for the search of the delay. Also other perceptually motivated similarity measures than correlation can be used. With the delay information, a sum signal is created (block 3B). It is constructed using following logic $$X_{sum}^b = \begin{cases} \left(X_{2,\tau_b}^b + X_3^b\right)/2 & \tau_b \le 0 \\ \left(X_2^b + X_{3,-\tau_b}^b\right)/2 & \tau_b > 0 \end{cases}, \tag{5}$$

where $\tau_b$ is the $\tau_b$ determined in equation (4).

In the sum signal the content (i.e., frequency-domain signal) of the channel in which an event occurs first is added as such, whereas the content (i.e., frequency-domain signal) of the channel in which the event occurs later is shifted to obtain the best match (block 3J).

Turning briefly to FIG. 1, a simple illustration helps to describe in broad, non-limiting terms, the shift $\tau_b$ and its operation above in equation (5). A sound source (S.S.) 131 creates an event described by the exemplary time-domain function $f_1(t)$ 130 received at microphone 2, 110-2. That is, the signal 120-2 would have some resemblance to the time-domain function $f_1(t)$ 130. Similarly, the same event, when received by microphone 3, 110-3 is described by the exemplary time-domain function $f_2(t)$ 140. It can be seen that the microphone 3, 110-3 receives a shifted version of $f_1(t)$ 130. In other words, in an ideal scenario, the function $f_2(t)$ 140 is simply a shifted version of the function $f_1(t)$ 130, where $f_2(t)=f_1(t-\tau_b)$ 130. Thus, in one aspect, the instant invention removes a time difference between when an occurrence of an event occurs at one microphone (e.g., microphone 3, 110-3) relative to when an occurrence of the event occurs at another microphone (e.g., microphone 2, 110-2). This situation is described as ideal because in reality the two microphones will likely experience different environments, their recording of the event could be influenced by constructive or destructive interference or elements that block or enhance sound from the event, etc.

The shift $\tau_b$ indicates how much closer the sound source is to microphone 2, 110-2 than microphone 3, 110-3 (when $\tau_b$ is positive, the sound source is closer to microphone 2 than microphone 3). The actual difference in distance can be calculated as $$\Delta_{23} = \frac{v\tau_b}{F_S}. \tag{6}$$

Utilizing basic geometry on the setup in FIG. 1, it can be determined that the angle of the arriving sound is equal to (returning to FIG. 3, this corresponds to block 3C)

$$\dot{\alpha}_b = \pm\cos^{-1}\left(\frac{\Delta_{23}^2 + 2b\Delta_{23} - d^2}{2db}\right), \tag{7}$$

where d is the distance between microphones and b is the estimated distance between sound sources and nearest microphone. Typically b can be set to a fixed value. For example b=2 meters has been found to provide stable results. Notice that there are two alternatives for the direction of the arriving sound as the exact direction cannot be determined with only two microphones.

The third microphone is utilized to define which of the signs in equation (7) is correct (block 3D). An example of a technique for performing block 3D is as described in reference to blocks 3F to 3I. The distances between microphone 1 and the two estimated sound sources are the following (block 3F):

$$\delta_b^+ = \sqrt{(h+b\sin(\dot{\alpha}_b))^2 + (d/2+b\cos(\dot{\alpha}_b))^2}$$

$$\delta_b^- = \sqrt{(h-b\sin(\dot{\alpha}_b))^2 + (d/2+b\cos(\dot{\alpha}_b))^2}, \tag{8}$$

where h is the height of the equilateral triangle, i.e.

$$h = \frac{\sqrt{3}}{2}d. \tag{9}$$

The distances in equation (8) are equal to delays (in samples) (block 3G)

$$\tau_b^+ = \frac{\delta^+ - b}{v}F_s$$

$$\tau_b^- = \frac{\delta^- - b}{v}F_s. \tag{10}$$

Out of these two delays, the one is selected that provides better correlation with the sum signal. The correlations are obtained as (block 3H)

$$c_b^+ = Re(\Sigma_{n=0}^{n_{b+1}-n_b-1}(X_{sum,\tau_b^+}^b(n)*X_1^b(n)))$$

$$c_b^- = Re(\Sigma_{n=0}^{n_{b+1}-n_b-1}(X_{sum,\tau_b^-}^b(n)*X_1^b(n))). \tag{11}$$

Now the direction is obtained of the dominant sound source for subband b (block 3I):

$$\alpha_b = \begin{cases} \dot{\alpha}_b & c_b^+ \ge c_b^- \\ -\dot{\alpha}_b & c_b^+ < c_b^- \end{cases}. \tag{12}$$

The same estimation is repeated for every subband (e.g., as described above in reference to FIG. 2).

Binaural Synthesis

Figure 4:
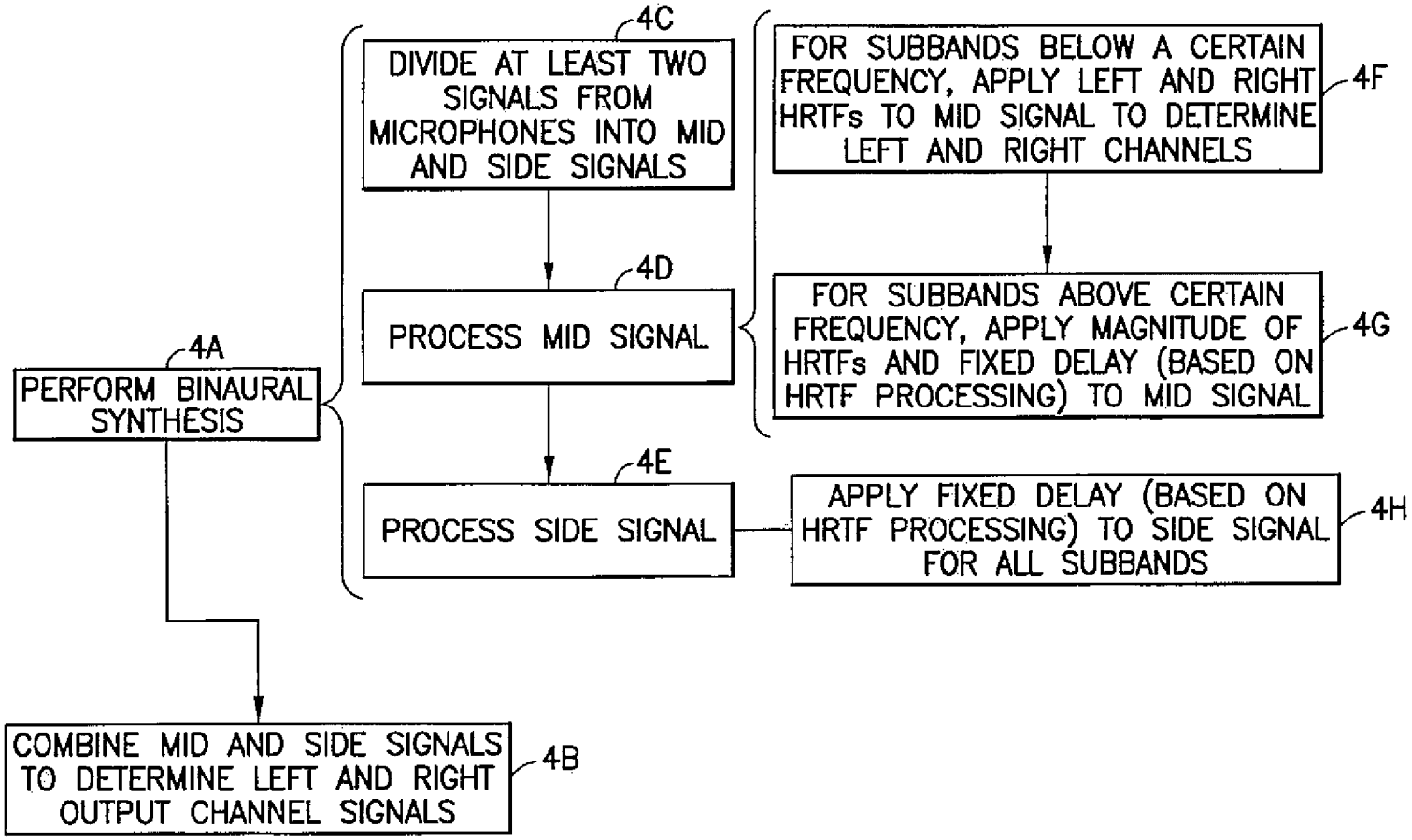
FIG. 4 is a block diagram of a flowchart for performing binaural synthesis and creating output channel signals therefrom.
Figure 5:
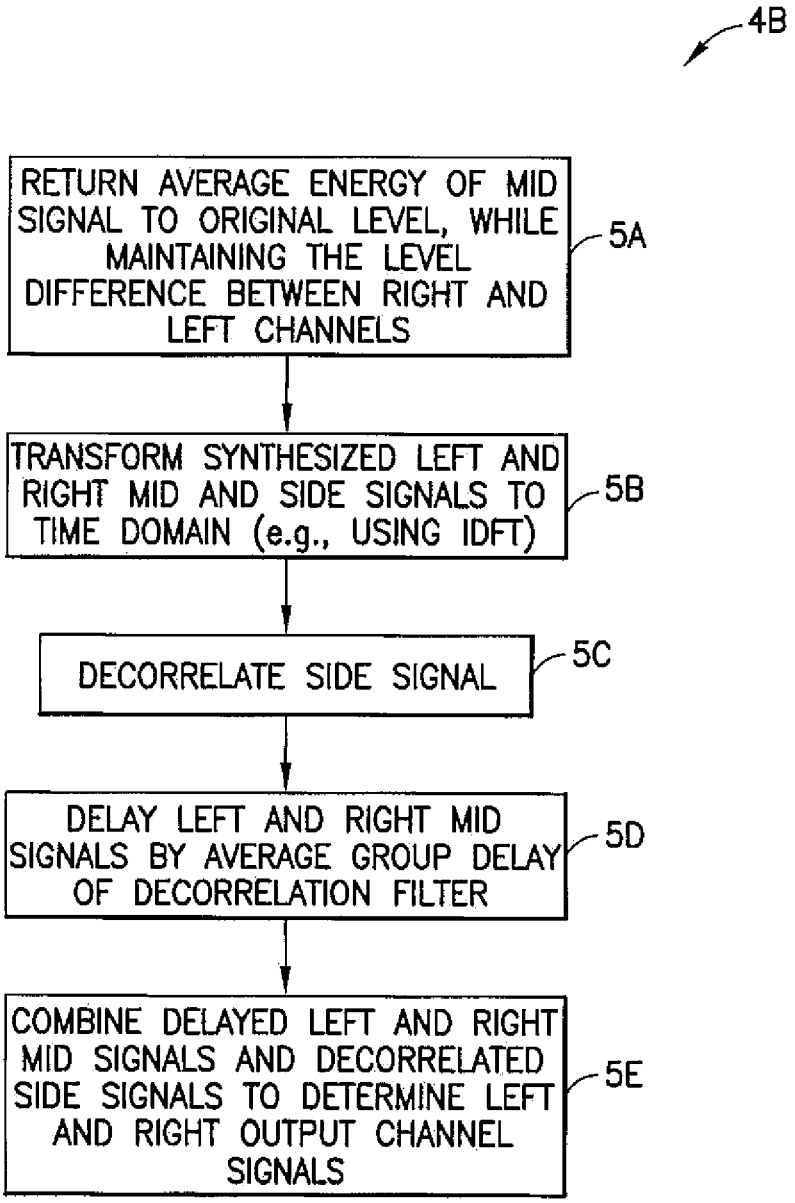
FIG. 5 is a block diagram of a flowchart for combining mid and side signals to determine left and right output channel signals.

With regard to the following binaural synthesis, reference is made to FIGS. 4 and 5. Exemplary binaural synthesis is described relative to block 4A. After the directional analysis, we now have estimates for the dominant sound source for every subband b. However, the dominant sound source is typically not the only source, and also the ambience should be considered. For that purpose, the signal is divided into two parts (block 4C): the mid and side signals. The main content in the mid signal is the dominant sound source which was found in the directional analysis. Respectively, the side signal mainly contains the other parts of the signal. In an exemplary proposed approach, mid and side signals are obtained for subband b as follows:

$$M^b = \begin{cases} \left(X^b_{2,\tau_b} + X^b_3\right)/2 & \tau_b \le 0 \\ \left(X^b_2 + X^b_{3,-\tau_b}\right)/2 & \tau_b > 0 \end{cases}, \tag{13}$$

$$S^b = \begin{cases} \left(X^b_{2,\tau_b} - X^b_3\right)/2 & \tau_b \le 0 \\ \left(X^b_2 - X^b_{3,-\tau_b}\right)/2 & \tau_b > 0 \end{cases}. \tag{14}$$

Notice that the mid signal $M^b$ is actually the same sum signal which was already obtained in equation (5) and includes a sum of a shifted signal and a non-shifted signal. The side signal $S^b$ includes a difference between a shifted signal and a non-shifted signal. The mid and side signals are constructed in a perceptually safe manner such that, in an exemplary embodiment, the signal in which an event occurs first is not shifted in the delay alignment (see, e.g., block 3J, described above). This approach is suitable as long as the microphones are relatively close to each other. If the distance between microphones is significant in relation to the distance to the sound source, a different solution is needed. For example, it can be selected that channel 2 is always modified to provide best match with channel 3.

Mid Signal Processing

Mid signal processing is performed in block 4D. An example of block 4D is described in reference to blocks 4F and 4G. Head related transfer functions (HRTF) are used to synthesize a binaural signal. For HRTF, see, e.g., B. Wiggins, "An Investigation into the Real-time Manipulation and Control of Three Dimensional Sound Fields", PhD thesis, University of Derby, Derby, UK, 2004. Since the analyzed directional information applies only to the mid component, only that is used in the HRTF filtering. For reduced complexity, filtering is performed in frequency domain. The time domain impulse responses for both ears and different angles, $h_{L,\alpha}(t)$ and $h_{R,\alpha}(t)$, are transformed to corresponding frequency domain representations $H_{L,\alpha}(n)$ and $H_{R,\alpha}(n)$ using DFT. Required numbers of zeroes are added to the end of the impulse responses to match the length of the transform window (N). HRTFs are typically provided only for one ear, and the other set of filters are obtained as mirror of the first set.

HRTF filtering introduces a delay to the input signal, and the delay varies as a function of direction of the arriving sound. Perceptually the delay is most important at low frequencies, typically for frequencies below 1.5 kHz. At higher frequencies, modifying the delay as a function of the desired sound direction does not bring any advantage, instead there is a risk of perceptual artifacts. Therefore different processing is used for frequencies below 1.5 kHz and for higher frequencies.

For low frequencies, the HRTF filtered set is obtained for one subband as a product of individual frequency components (block 4F):

$$\tilde{M}_L^b(n) = M^b(n) H_{L,\alpha_b}(n_b+n), n=0, \ldots, n_{b+1}-n_b-1,$$

$$\tilde{M}_R^b(n) = M^b(n) H_{R,\alpha_b}(n_b+n), n=0, \ldots, n_{b+1}-n_b-1. \tag{15}$$

The usage of HRTFs is straightforward. For direction (angle) β, there are HRTF filters for left and right ears, $HL_\beta(z)$ and $HR_\beta(z)$, respectively. A binaural signal with sound source S(z) in direction β is generated straightforwardly as $L(z)=HL_\beta(z)S(z)$ and $R(z)=HR_\beta(z)S(z)$, where L(z) and R(z) are the input signals for left and right ears. The same filtering can be performed in DFT domain as presented in equation (15). For the subbands at higher frequencies the processing goes as follows (block 4G) (equation 16):

$$\tilde{M}_L^b(n) = M^b(n) |H_{L,\alpha_b}(n_b+n)| e^{-j\frac{2\pi(n+n_b)\tau_{HRTF}}{N}},$$

$$n = 0, \ldots, n_{b+1}-n_b-1,$$

$$\tilde{M}_R^b(n) = M^b(n) |H_{R,\alpha_b}(n_b+n)| e^{-j\frac{2\pi(n+n_b)\tau_{HRTF}}{N}},$$

$$n = 0, \ldots, n_{b+1}-n_b-1.$$

It can be seen that only the magnitude part of the HRTF filters are used, i.e., the delays are not modified. On the other hand, a fixed delay of $\tau_{HRTF}$ samples is added to the signal. This is used because the processing of the low frequencies (equation (15)) introduces a delay to the signal. To avoid a mismatch between low and high frequencies, this delay needs to be compensated. $\tau_{HRTF}$ is the average delay introduced by HRTF filtering and it has been found that delaying all the high frequencies with this average delay provides good results. The value of the average delay is dependent on the distance between sound sources and microphones in the used HRTF set.

Side Signal Processing

Processing of the side signal occurs in block 4E. An example of such processing is shown in block 4H. The side signal does not have any directional information, and thus no HRTF processing is needed. However, delay caused by the HRTF filtering has to be compensated also for the side signal. This is done similarly as for the high frequencies of the mid signal (block 4H):

$$\tilde{S}^b(n) = S^b(n) e^{-j\frac{2\pi(n+n_b)\tau_{HRTF}}{N}}, n = 0, \ldots, n_{b+1}-n_b-1. \tag{17}$$

For the side signal, the processing is equal for low and high frequencies.

Combining Mid and Side Signals

In block 4B, the mid and side signals are combined to determine left and right output channel signals. Exemplary techniques for this are shown in FIG. 5, blocks 5A-5E. The mid signal has been processed with HRTFs for directional information, and the side signal has been shifted to maintain the synchronization with the mid signal. However, before combining mid and side signals, there still is a property of the HRTF filtering which should be considered: HRTF filtering typically amplifies or attenuates certain frequency regions in the signal. In many cases, also the whole signal is attenuated. Therefore, the amplitudes of the mid and side signals may not correspond to each other. To fix this, the average energy of mid signal is returned to the original level, while still maintaining the level difference between left and right channels (block 5A). In one approach, this is performed separately for every subband.

The scaling factor for subband b is obtained as $$\varepsilon^b = \sqrt{\frac{2\left(\sum_{n=n_b}^{n_{b+1}-1} |M^b(n)|^2\right)}{\sum_{n=n_b}^{n_{b+1}-1} |\overline{M}_L^b(n)|^2 + \sum_{n=n_b}^{n_{b+1}-1} |\tilde{M}_R^b(n)|^2}}. \quad (18)$$

Now the scaled mid signal is obtained as:

$$\overline{M}_L^b = \epsilon^b \tilde{M}_L^b,$$

$$\overline{M}_R^b = \epsilon^b \tilde{M}_R^b. \quad (19)$$

Synthesized mid and side signals $\overline{M}_L$, $\overline{M}_R$ and $\tilde{S}$ are transformed to the time domain using the inverse DFT (IDFT) (block 5B). In an exemplary embodiment, $D_{tot}$ last samples of the frames are removed and sinusoidal windowing is applied. The new frame is combined with the previous one with, in an exemplary embodiment, 50 percent overlap, resulting in the overlapping part of the synthesized signals $m_L(t)$, $m_R(t)$ and s(t).

The externalization of the output signal can be further enhanced by the means of decorrelation. In an embodiment, decorrelation is applied only to the side signal (block 5C), which represents the ambience part. Many kinds of decorrelation methods can be used, but described here is a method applying an all-pass type of decorrelation filter to the synthesized binaural signals. The applied filter is of the form $$D_L(z) = \frac{\beta + z^{-P}}{1 + \beta z^{-P}}, \quad (20)$$

$$D_R(z) = \frac{-\beta + z^{-P}}{1 - \beta z^{-P}}.$$

where P is set to a fixed value, for example 50 samples for a 32 kHz signal. The parameter β is used such that the parameter is assigned opposite values for the two channels. For example 0.4 is a suitable value for β. Notice that there is a different decorrelation filter for each of the left and right channels.

The output left and right channels are now obtained as (block 5E):

$$L(z) = z^{-P_D} M_L(z) + D_L(z) S(z)$$

$$R(z) = z^{-P_D} M_R(z) + D_R(z) S(z)$$

where $P_D$ is the average group delay of the decorrelation filter (equation (20)) (block 5D), and $M_L$ (z), $M_R$ (z) and S(z) are z-domain representations of the corresponding time domains signals.

Exemplary System

Figure 6:
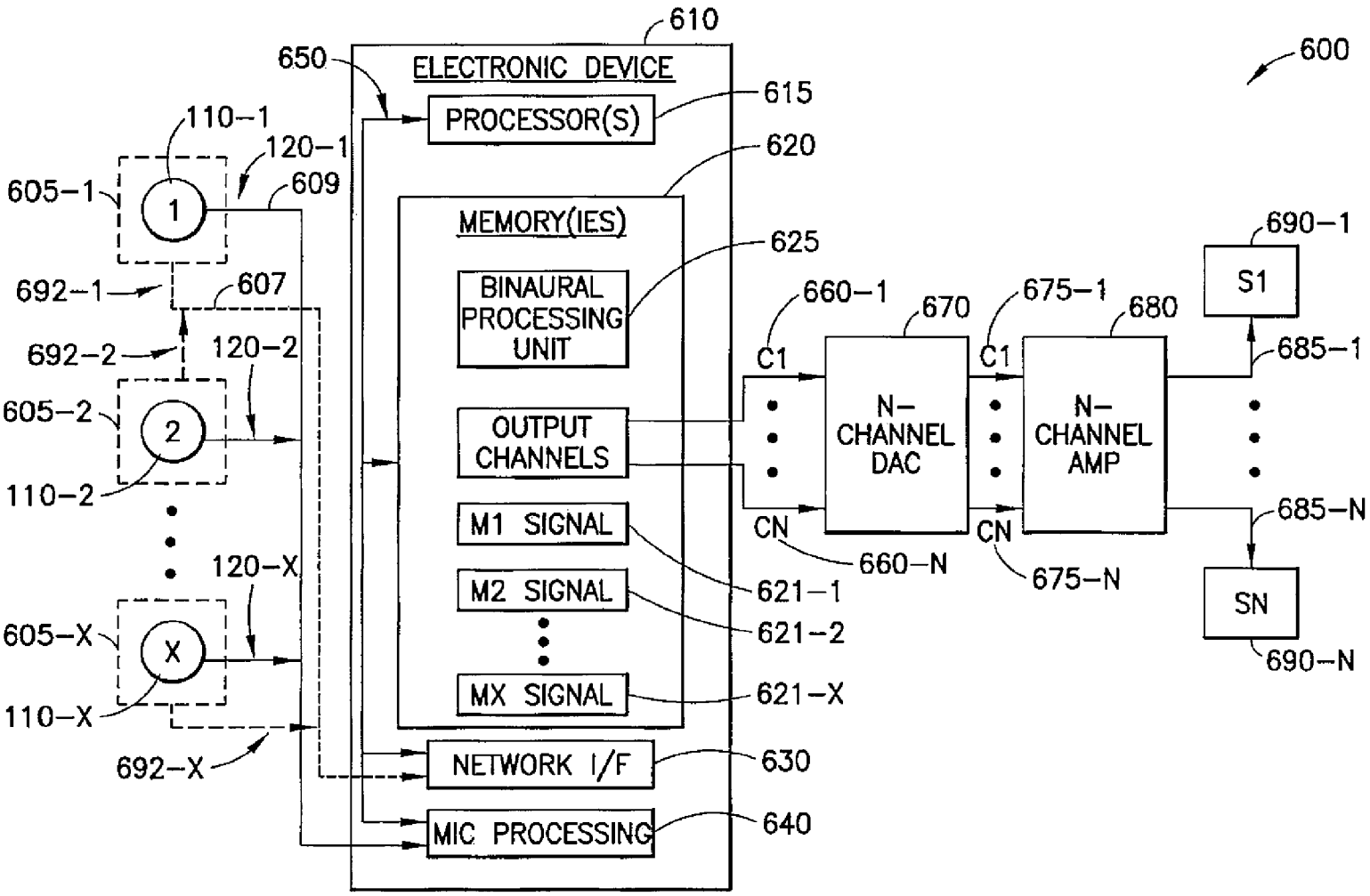
FIG. 6 is a block diagram of a system suitable for performing embodiments of the invention.

Turning to FIG. 6, a block diagram is shown of a system 600 suitable for performing embodiments of the invention. System 600 includes X microphones 110-1 through 110-X that are capable of being coupled to an electronic device 610 via wired connections 609. The electronic device 610 includes one or more processors 615, one or more memories 620, one or more network interfaces 630, and a microphone processing module 640, all interconnected through one or more buses 650. The one or more memories 620 include a binaural processing unit 625, output channels 660-1 through 660-N, and frequency-domain microphone signals M1 621-1 through MX 621-X. In the exemplary embodiment of FIG. 6, the binaural processing unit 625 contains computer program code that, when executed by the processors 615, causes the electronic device 610 to carry out one or more of the operations described herein. In another exemplary embodiment, the binaural processing unit or a portion thereof is implemented in hardware (e.g., a semiconductor circuit) that is defined to perform one or more of the operations described above.

In this example, the microphone processing module 640 takes analog microphone signals 120-1 through 120-X, converts them to equivalent digital microphone signals (not shown), and converts the digital microphone signals to frequency-domain microphone signals M1 621-1 through MX 621-X.

The electronic device 610 can include, but are not limited to, cellular telephones, personal digital assistants (PDAs), computers, image capture devices such as digital cameras, gaming devices, music storage and playback appliances, Internet appliances permitting Internet access and browsing, as well as portable or stationary units or terminals that incorporate combinations of such functions.

In an example, the binaural processing unit acts on the frequency-domain microphone signals 621-1 through 621-X and performs the operations in the block diagrams shown in FIGS. 2-5 to produce the output channels 660-1 through 660-N. Although right and left output channels are described in FIGS. 2-5, the rendering can be extended to higher numbers of channels, such as 5, 7, 9, or 11.

For illustrative purposes, the electronic device 610 is shown coupled to an N-channel DAC (digital to audio converter) 670 and an n-channel amp (amplifier) 680, although these may also be integral to the electronic device 610. The N-channel DAC 670 converts the digital output channel signals 660 to analog output channel signals 675, which are then amplified by the N-channel amp 680 for playback on N speakers 690 via N amplified analog output channel signals 685. The speakers 690 may also be integrated into the electronic device 610. Each speaker 690 may include one or more drivers (not shown) for sound reproduction.

The microphones 110 may be omnidirectional microphones connected via wired connections 609 to the microphone processing module 640. In another example, each of the electronic devices 605-1 through 605-X has an associated microphone 110 and digitizes a microphone signal 120 to create a digital microphone signal (e.g., 692-1 through 692-X) that is communicated to the electronic device 610 via a wired or wireless network 609 to the network interface 630. In this case, the binaural processing unit 625 (or some other device in electronic device 610) would convert the digital microphone signal 692 to a corresponding frequency-domain signal 621. As yet another example, each of the electronic devices 605-1 through 605-X has an associated microphone 110, digitizes a microphone signal 120 to create a digital microphone signal 692, and converts the digital microphone signal 692 to a corresponding frequency-domain signal 621 that is communicated to the electronic device 610 via a wired or wireless network 609 to the network interface 630.

Signal Coding

Proposed techniques can be combined with signal coding solutions. Two channels (mid and side) as well as directional information need to be coded and submitted to a decoder to be able to synthesize the signal. The directional information can be coded with a few kilobits per second.

Figure 7:
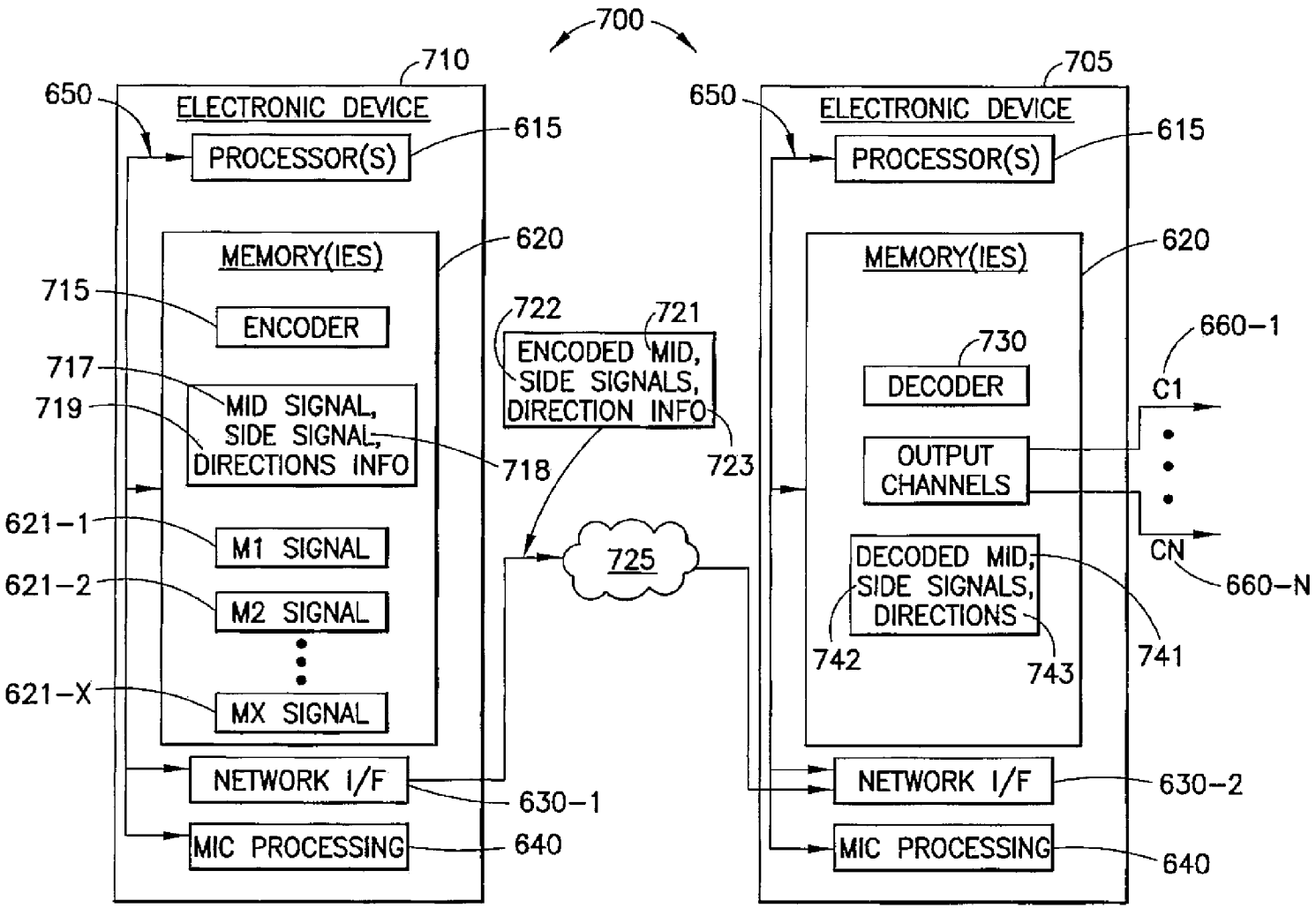
FIG. 7 is a block diagram of a second system suitable for performing embodiments of the invention for signal coding aspects of the invention.
Figure 9:
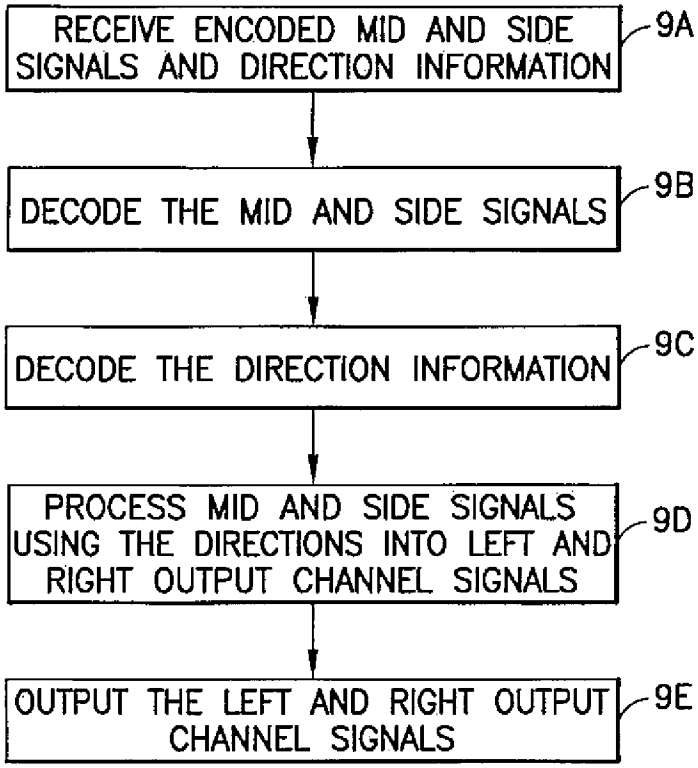
FIG. 9 is a block diagram of operations performed by the decoder from FIG. 7.
Figure 8:
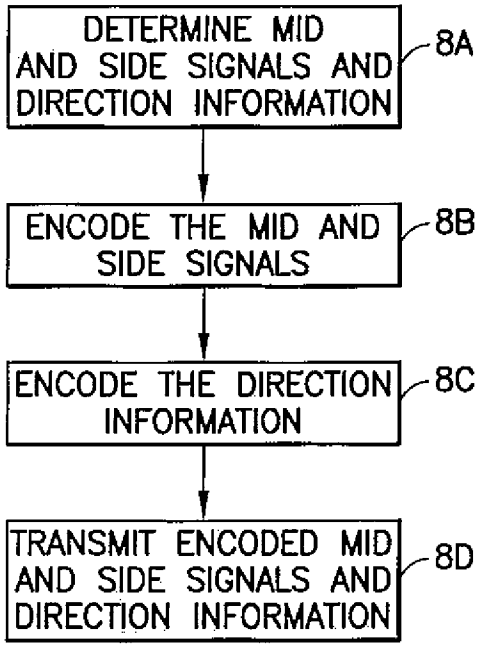
FIG. 8 is a block diagram of operations performed by the encoder from FIG. 7.

FIG. 7 illustrates a block diagram of a second system 700 suitable for performing embodiments of the invention for signal coding aspects of the invention. FIG. 8 is a block diagram of operations performed by the encoder from FIG. 7, and FIG. 9 is a block diagram of operations performed by the decoder from FIG. 7. There are two electronic devices 710, 705 that communicate using their network interfaces 630-1, 630-2, respectively, via a wired or wireless network 725. The encoder 715 performs operations on the frequency-domain microphone signals 621 to create at least the mid signal 717 (see equation (13)). Additionally, the encoder 715 may also create the side signal 718 (see equation (14) above), along with the directions 719 (see equation (12) above) via, e.g., the equations (1)-(14) described above (block 8A of FIG. 8). The options include (1) only the mid signal, (2) the mid signal and directional information, or (3) the mid signal and directional information and the side signal. Conceivably, there could also be (4) mid signal and side signal and (5) side signal alone, although these might be less useful than the options (1) to (3).

The encoder 715 also encodes these as encoded mid signal 721, encoded side signal 722, and encoded directional information 723 for coupling via the network 725 to the electronic device 705. The mid signal 717 and side signal 718 can be coded independently using commonly used audio codecs (coder/decoders) to create the encoded mid signal 721 and the encoded side signal 722, respectively. Suitable commonly used audio codes are for example AMR-WB+, MP3, AAC and AAC+. This occurs in block 8B. For coding the directions 719 (i.e., $\alpha_b$ from equation (12)) (block 8C), as an example, assume a typical codec structure with 20 ms (millisecond) frames (50 frames per second) and 20 sub-bands per frame (B=20). Every $\alpha_b$ can be quantized for example with five bits, providing resolution of 11.25 degrees for the arriving sound direction, which is enough for most applications. In this case, the overall bit rate for the coded directions would be 50*20*5=5.00 kbps (kilobits per second) as encoded directional information 723. Using more advanced coding techniques (lower resolution is needed for directional information at higher frequencies; there is typically correlation between estimated sound directions in different subbands which can be utilized in coding, etc.), this rate could probably be dropped, for example, to 3 kbps. The network interface 630-1 then transmits the encoded mid signal 721, the encoded side signal 722, and the encoded directional information 723 in block 8D.

The decoder 730 in the electronic device 705 receives (block 9A) the encoded mid signal 721, the encoded side signal 722, and the encoded directional information 723, e.g., via the network interface 630-2. The decoder 730 then decodes (block 9B) the encoded mid signal 721 and the encoded side signal 722 to create the decoded mid signal 741 and the decoded side signal 742. In block 9C, the decoder uses the encoded directional information 719 to create the decoded directions 743. The decoder 730 then performs equations (15) to (21) above (block 9D) using the decoded mid signal 741, the decoded side signal 742, and the decoded directions 743 to determine the output channel signals 660-1 through 660-N. These output channels 660 are then output in block 9E, e.g., to an internal or external N-channel DAC.

In the exemplary embodiment of FIG. 7, the encoder 715/decoder 730 contains computer program code that, when executed by the processors 615, causes the electronic device 710/705 to carry out one or more of the operations described herein. In another exemplary embodiment, the encoder/decoder or a portion thereof is implemented in hardware (e.g., a semiconductor circuit) that is defined to perform one or more of the operations described above.

Alternative Implementations

Above, an exemplary implementation was described. However, there are numerous alternative implementations which can be used as well. Just to mention few of them:

1) Numerous different microphone setups can be used. The algorithms have to be adjusted accordingly. The basic algorithm has been designed for three microphones, but more microphones can be used, for example to make sure that the estimated sound source directions are correct.

2) The algorithm is not especially complex, but if desired it is possible to submit three (or more) signals first to a separate computation unit which then performs the actual processing.

3) It is possible to make the recordings and the actual processing in different locations. For instance, three independent devices, each with one microphone can be used, which then transmit the signal to a separate processing unit (e.g., server) which then performs the actual conversion to binaural signal.

4) It is possible to create binaural signal using only directional information, i.e. side signal is not used at all. Considering solutions in which the binaural signal is coded, this provides lower total bit rate as only one channel needs to be coded.

5) HRTFs can be normalized beforehand such that normalization (equation (19)) does not have to be repeated after every HRTF filtering.

6) The left and right signals can be created already in frequency domain before inverse DFT. In this case the possible decorrelation filtering is performed directly for left and right signals, and not for the side signal.

Furthermore, in addition to the embodiments mentioned above, the embodiments of the invention may be used also for:

1) Gaming applications;

2) Augmented reality solutions;

3) Sound scene modification: amplification or removal of sound sources from certain directions, background noise removal/amplification, and the like.

However, these may require further modification of the algorithm such that the original spatial sound is modified. Adding those features to the above proposal is however relatively straightforward.

Techniques for Converting Multi-Microphone Capture to Multi-Channel Signals

Reference was made above, e.g., in regards to FIG. 6, with providing multiple digital output signals 660. This section describes additional exemplary embodiments for providing such signals.

An exemplary problem is to convert the capture of multiple omnidirectional microphones in known locations into good quality multichannel sound. In the below material, a 5.1 channel system is considered, but the techniques can be straightforwardly extended to other multichannel loudspeaker systems as well. In the capture end, a system is referred to with three microphones on horizontal level in the shape of a triangle, as illustrated in FIG. 1. However, also in the recording end the used techniques can be easily generalized to different microphone setups. An exemplary requirement is that all the microphones are able to capture sound events from all directions.

The problem of converting multi-microphone capture into a multichannel output signal is to some extent consistent with the problem of converting multi-microphone capture into a binaural (e.g., headphone) signal. It was found that a similar analysis can be used for multichannel synthesis as described above. This brings significant advantages to the implementation, as the system can be configured to support several output signal types. In addition, the signal can be compressed efficiently.

A problem then is how to turn spatially analyzed input signals into multichannel loudspeaker output with good quality, while maintaining the benefit of efficient compression and support for different output types. The materials describe below present exemplary embodiments to solve this and other problems.

Overview

In the below-described exemplary embodiments, the directional analysis is mainly based on the above techniques. However, there are a few modifications, which are discussed below.

It will be now detailed how the developed mid/side representations can be utilized together with the directional information for synthesizing multi-channel output signals. As an exemplary overview, a mid signal is used for generating directional multi-channel information and the side signal is used as a starting point for ambience signal. It should be noted that the multi-channel synthesis described below is quite a bit different from the binaural synthesis described above and utilizes different technologies.

The estimation of directional information may especially in noisy situations not be particularly accurate, which is not a perceptually desirable situation for multi-channel output formats. Therefore, as an exemplary embodiment of the instant invention, subbands with dominant sound source directions are emphasized and potentially single subbands with deviating directional estimates are attenuated. That is, in case the direction of sound cannot be reliably estimated, then the sound is divided more evenly to all reproduction channels, i.e., it is assumed that in this case all the sound is rather ambient-like. The modified directional information is used together with the mid signal to generate directional components of the multi-channel signals. A directional component is a part of the signal that a human listener perceives coming from a certain direction. A directional component is opposite from an ambient component, which is perceived to come from all directions. The side signal is also, in an exemplary embodiment, extended to the multi-channel format and the channels are decorrelated to enhance a feeling of ambience. Finally, the directional and ambience components are combined and the synthesized multi-channel output is obtained.

One should also notice that the exemplary proposed solutions enable efficient, good-quality compression of multi-channel signals, because the compression can be performed before synthesis. That is, the information to be compressed includes mid and side signals and directional information, which is clearly less than what the compression of 5.1 channels would need.

Directional Analysis

The directional analysis method proposed for the examples below follows the techniques used above. However, there are a few small differences, which are introduced in this section.

Directional analysis (block 10A of FIG. 10) is performed in the DFT (i.e., frequency) domain. One difference from the techniques used above is that while adding zeroes to the end of the time domain window before the DFT transform, the delay caused by HRTF filtering does not have to be considered in the case of multi-channel output.

As described above, it was assumed that a dominant sound source direction for every subband was found. However, in the multi-channel situation, it has been noticed that in some cases, it is better not to define the direction of a dominant sound source, especially if correlation values between microphone channels are low. The following correlation computation $$\max_{\tau_b} Re(\Sigma_{n=0}^{n_{b+1}-n_b-1}(X_{2,\tau_b}^{\ b}(n)*X_3^{\ b}(n))),\tau_b\epsilon[-D_{max}, D_{max}] \tag{21}$$

provides information on the degree of similarity between channels. If the correlation appears to be low, a special procedure (block 10E of FIG. 10) can be applied. This procedure operates as follows:

If $\max_{\tau_b} \mathrm{Re}\ (\Sigma_{n=0}^{n_{b+1}-n_b-1}(X_{2,\tau_b}^{\ b}(n)*X_3^{\ b}(n)))<\mathrm{cor_lim}_b$:

$\alpha_b=\emptyset$;

$\tau_b=0$;

Else

Obtain $\alpha_b$ as previously indicated above (e.g., equation 12).

In the above, $\mathrm{cor_lim}_b$ is the lowest value for an accepted correlation for subband b, and Ø indicates a special situation that there is not any particular direction for the subband. If there is not any particularly dominant direction, also the delay $\tau_b$ is set to zero. Typically, $\mathrm{cor_lim}_b$ values are selected such that stronger correlation is required for lower frequencies than for higher frequencies. It is noted that the correlation calculation in equation 21 affects how the mid channel energy is distributed. If the correlation is above the threshold, then the mid channel energy is distributed mostly to one or two channels, whereas if the correlation is below the threshold then the mid channel energy is distributed rather evenly to all the channels. In this way, the dominant sound source is emphasized relative to other directions if the correlation is high.

Above, the directional estimation for subband b was described. This estimation is repeated for every subband. It is noted that the implementation (e.g., via block 10E of FIG. 1) of equation (21) emphasizes the dominant source directions relative to other directions once the mid signal is determined (as described below; see equation 22).

Multi-Channel Synthesis

This section describes how multi-channel signals are generated from the input microphone signals utilizing the directional information. The description will mainly concentrate on generating 5.1 channel output. However, it is straightforward to extend the method to other multi-channel formats (e.g., 5-channel, 7-channel, 9-channel, with or without the LFE signal) as well. It should be noted that this synthesis is different from binaural signal synthesis described above, as the sound sources should be panned to directions of the speakers. That is, the amplitudes of the sound sources should be set to the correct level while still maintaining the spatial ambience sound generated by the mid/side representations.

After the directional analysis as described above, estimates for the dominant sound source for every subband b have been determined. However, the dominant sound source is typically not the only source. Additionally, the ambience should be considered. For that purpose, the signal is divided into two parts: the mid and side signals. The main content in the mid signal is the dominant sound source, which was found in the directional analysis. The side signal mainly contains the other parts of the signal. In an exemplary proposed approach, mid (M) signals and side (S) signals are obtained for subband b as follows (block 10B of FIG. 10):

$$M^b = \begin{cases} \left(X_{2,\tau_b}^b + X_3^b\right)/2 & \tau_b \le 0 \\ \left(X_2^b + X_{3,-\tau_b}^b\right)/2 & \tau_b > 0 \end{cases} \tag{22}$$

-continued $$S^b = \begin{cases} \left(X^b_{2,\tau_b} - X^b_3\right)/2 & \tau_b \le 0 \\ \left(X^b_2 - X^b_{3,-\tau_b}\right)/2 & \tau_b > 0 \end{cases} \quad (23)$$

For equation 22, see also equations 5 and 13 above; for equation 23, see also equation 14 above. It is noted that the $\tau_b$ in equations (22) and (23) have been modified by the directional analysis described above, and this modification emphasizes the dominant source directions relative to other directions once the mid signal is determined per equation 22. The mid and side signals are constructed in a perceptually safe manner such that the signal in which an event occurs first is not shifted in the delay alignment. This approach is suitable as long as the microphones are relatively close to each other. If the distance is significant in relation to the distance to the sound source, a different solution is needed. For example, it can be selected that channel 2 (two) is always modified to provide the best match with channel 3 (three).

A 5.1 multi-channel system consists of 6 channels: center (C), front-left (F_L), front-right (F_R), rear-left (R_L), rear-right (R_R), and low frequency channel (LFE). In an exemplary embodiment, the center channel speaker is placed at zero degrees, the left and right channels are placed at ±30 degrees, and the rear channels are placed at ±110 degrees. These are merely exemplary and other placements may be used. The LFE channel contains only low frequencies and does not have any particular direction. There are different methods for panning a sound source to a desired direction in 5.1 multi-channel system. A reference having one possible panning technique is Craven P. G., "Continuous surround panning for 5-speaker reproduction," in AES 24th International Conference on Multi-channel Audio, June 2003. In this reference, for a subband b, a sound source $Y^b$ in direction θ introduces content to channels as follows:

$$C^b = g_C{}^b(\theta)Y^b$$

$$F_L^b = g_{FL}{}^b(\theta)Y^b$$

$$F_R^b = g_{FR}{}^b(\theta)Y^b$$

$$R_L^b = g_{RL}{}^b(\theta)Y^b$$

$$R_R^b = g_{RR}{}^b(\theta)Y^b \quad (24)$$

where $Y^b$ corresponds to the bth subband of signal Y and $g_X{}^b(\theta)$ (where X is one of the output channels) is a gain factor for the same signal. The signal Y here is an ideal non-existing sound source that is desired to appear coming from direction θ. The gain factors are obtained as a function of θ as follows (equation 25):

$$g_C{}^b(\theta) = 0.10492 + 0.33223\cos(\theta) + 0.26500\cos(2\theta) + 0.16902\cos(3\theta) + 0.05978\cos(4\theta);$$

$$g_{FL}{}^b(\theta) = 0.16656 + 0.24162\cos(\theta) + 0.27215\sin(\theta) - 0.05322\cos(2\theta) + 0.22189\sin(2\theta) - 0.08418\cos(3\theta) + 0.05939\sin(3\theta) - 0.06994\cos(4\theta) + 0.08435\sin(4\theta);$$

$$g_{FR}{}^b(\theta) = 0.16656 + 0.24162\cos(\theta) - 0.27215\sin(\theta) - 0.05322\cos(2\theta) - 0.22189\sin(2\theta) - 0.08418\cos(3\theta) - 0.05939\sin(3\theta) - 0.06994\cos(4\theta) - 0.08435\sin(4\theta);$$

$$g_{RL}{}^b(\theta) = 0.35579 - 0.35965\cos(\theta) + 0.42548\sin(\theta) - 0.06361\cos(2\theta) - 0.11778\sin(2\theta) + 0.00012\cos(3\theta) - 0.04692\sin(3\theta) + 0.02722\cos(4\theta) - 0.06146\sin(4\theta);$$

$$g_{RR}{}^b(\theta) = 0.35579 - 0.35965\cos(\theta) - 0.42548\sin(\theta) - 0.06361\cos(2\theta) + 0.11778\sin(2\theta) + 0.00012\cos(3\theta) + 0.04692\sin(3\theta) + 0.02722\cos(4\theta) + 0.06146\sin(4\theta).$$

A special case of above situation occurs when there is no particular direction, i.e., θ=Ø. In that case fixed values can be used as follows:

$$g_C{}^b(Ø) = \delta_C$$

$$g_{FL}{}^b(Ø) = \delta_{FL}$$

$$g_{FR}{}^b(Ø) = \delta_{FR}$$

$$g_{RL}{}^b(Ø) = \delta_{RL}$$

$$g_{RR}{}^b(Ø) = \delta_{RR} \quad (26)$$

where parameters $\delta_X$ are fixed values selected such that the sound caused by the mid signal is equally loud in all directional components of the mid signal.

Mid Signal Processing

With the above-described method, a sound can be panned around to a desired direction. In an exemplary embodiment of the instant invention, this panning is applied only for mid signal $M^b$. By substituting the directional information $\alpha^b$ to equation (25), the gain factors $g_X{}^b(\alpha^b)$ are obtained (block 10C of FIG. 10) for every channel and subband. It is noted that the techniques herein are described as being applicable to 5 or more channels (e.g. 5.1, 7.1, 11.1), but the techniques are also suitable for two or more channels (e.g., from stereo to other multi-channel outputs).

Using equation (24), the directional component of the multi-channel signals may be generated. However, before panning, in an exemplary embodiment, the gain factors $g_X{}^b(\alpha^b)$ are modified slightly. This is because due to, for example, background noise and other disruptions, the estimation of the arriving sound direction does not always work perfectly. For example, if for one individual subband the direction of the arriving sound is estimated completely incorrectly, the synthesis would generate a disturbing unconnected short sound event to a direction where there are no other sound sources. This kind of error can be disturbing in a multi-channel output format. To avoid this, in an exemplary embodiment (see block 10F of FIG. 10), preprocessing is applied for gain values $g_X{}^b$. More specifically, a smoothing filter h(k) with length of 2K+1 samples is applied as follows:

$$\hat{g}_X{}^b = \Sigma_{k=0}{}^{2K}(h(k)g_X{}^{b-K+k}), K \le b \le B-(K+1). \quad (27)$$

For clarity, directional indices $\alpha^b$ have been omitted from the equation. It is noted that application of equation 27 (e.g., via block 10F of FIG. 10) has the effect of attenuating deviating directional estimates. Filter h(k) is selected such that $\Sigma_{k=0}{}^{2K}h(k)=1$. For example when K=2, h(k) can be selected as $$h(k) = \{1/12, 1/4, 1/3, 1/4, 1/12\}, k = 0, \ldots, 4. \quad (28)$$

For the K first and last subbands, a slightly modified smoothing is used as follows:

$$\hat{g}_X^b = \frac{\sum_{k=K-b}^{2K}(h(k)g_X^{b-K+k})}{\sum_{k=K-b}^{2K}h(k)}, 0 \le b \le K, \quad (29)$$

-continued $$\hat{g}_X^b = \frac{\sum_{k=0}^{K+B-1-b} (h(k) g_X^{b-K+k})}{\sum_{k=0}^{K+B-1-b} h(k)}, \quad B-K \le b \le B-1, \tag{30}$$

With equations (27), (29) and (30), smoothed gain values $\hat{g}_X^b$ are achieved. It is noted that the filter has the effect of attenuating sudden changes and therefore the filter attenuates deviating directional estimates (and thereby emphasizes the dominant sound source relative to other directions). The values from the filter are now applied to equation (24) to obtain (block 10D of FIG. 10) directional components from the mid signal:

$$C_M^b = \hat{g}_C^b M^b$$

$$F_L_M^b = \hat{g}_{FL}^b M^b$$

$$F_R_M^b = \hat{g}_{FR}^b M^b$$

$$R_L_M^b = \hat{g}_{RL}^b M^b$$

$$R_R_M^b = \hat{g}_{RR}^b M^b. \tag{31}$$

It is noted in equation (31) that $M^b$ substitutes for Y. The signal Y is not a microphone signal but rather an ideal non-existing sound source that is desired to appear coming from direction θ. In the technique of equation 31, an optimistic assumption is made that one can use the mid ($M^b$) signal in place of the ideal non-existing sound source signals (Y). This assumption works rather well.

Finally, all the channels are transformed into the time domain (block 10G of FIG. 10) using an inverse DFT, sinusoidal windowing is applied, and the overlapping parts of the adjacent frames are combined. After all of these stages, the result in this example is five time-domain signals.

Notice above that only one smoothing filter structure was presented. However, many different smoothing filters can be used. The main idea is to remove individual sound events in directions where there are no other sound occurrences.

Side Signal Processing

The side signal $S^b$ is transformed (block 10G) to the time domain using inverse DFT and, together with sinusoidal windowing, the overlapping parts of the adjacent frames are combined. The time-domain version of the side signal is used for creating an ambience component to the output. The ambience component does not have any directional information, but this component is used for providing a more natural spatial experience.

Figure 10:
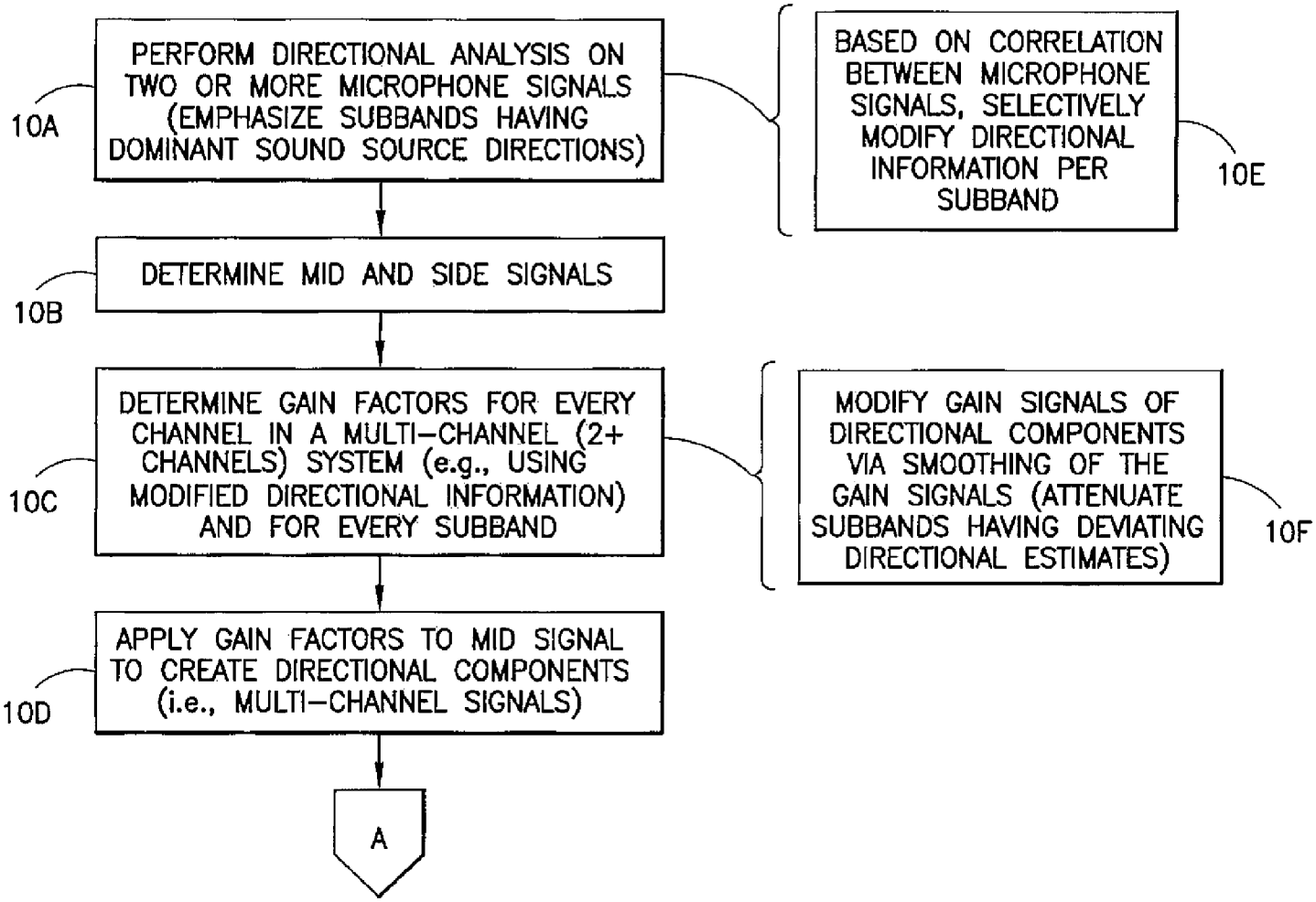
FIG. 10 is a block diagram of a flowchart for synthesizing multi-channel output signals from recorded microphone signals.
Figure 10:
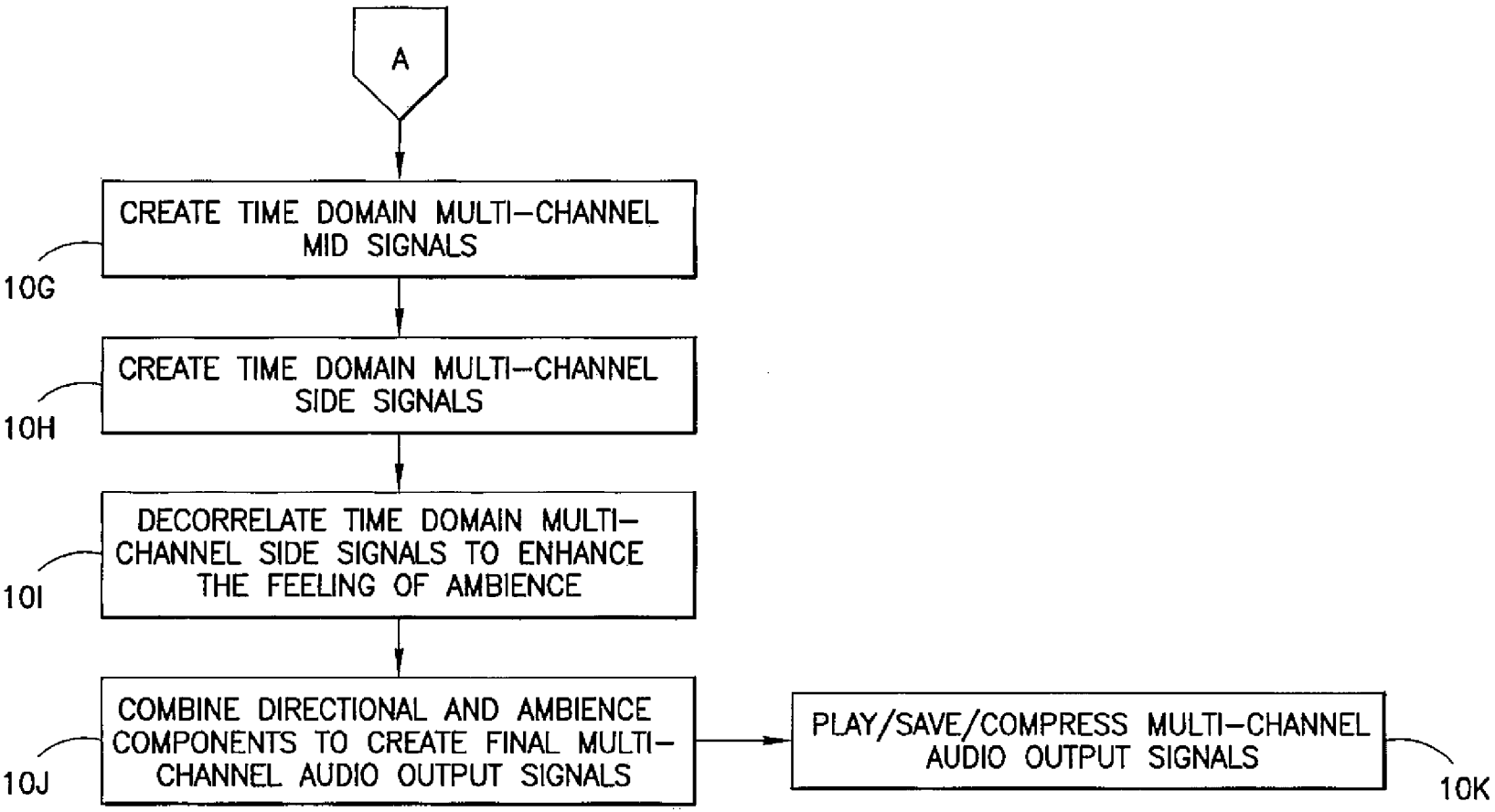

The externalization of the ambience component can be enhanced by the means, an exemplary embodiment, of decorrelation (block 10I of FIG. 10). In this example, individual ambience signals are generated for every output channel by applying different decorrelation process to every channel. Many kinds of decorrelation methods can be used, but an all-pass type of decorrelation filter is considered below. The considered filter is of the form $$D_X(z) = \frac{\beta_X + z^{-P_X}}{1 + \beta_X z^{-P_X}}, \tag{32}$$

where X is one of the output channels as before, i.e., every channel has a different decorrelation with its own parameters $\beta_X$ and $P_X$. Now all the ambience signals are obtained from time domain side signal S(z) as follows:

$$C_S(z) = D_C(z) S(z)$$

$$F_L_S(z) = D_{F_L}(z) S(z)$$

$$F_R_S(z) = D_{F_R}(z) S(z)$$

$$R_L_S(z) = D_{R_L}(z) S(z)$$

$$R_R_S(z) = D_{R_R}(z) S(z) \tag{33}$$

The parameters of the decorrelation filters, $\beta_X$ and $P_X$, are selected in a suitable manner such that any filter is not too similar with another filter, i.e., the cross-correlation between decorrelated channels must be reasonably low. On the other hand, the average group delay of the filters should be reasonably close to each other.

Combining Directional and Ambience Components

We now have time domain directional and ambience signals for all five output channels. These signals are combined (block 10J) as follows:

$$C(z) = z^{-P_D} C_M(z) + \gamma C_S(z)$$

$$F_L(z) = z^{-P_D} F_L_M(z) + \gamma F_L_S(z)$$

$$F_R(z) = z^{-P_D} F_R_M(z) + \gamma F_R_S(z)$$

$$R_L(z) = z^{-P_D} R_L_M(z) + \gamma R_L_S(z)$$

$$R_R(z) = z^{-P_D} R_R_M(z) + \gamma R_R_S(z), \tag{34}$$

where $P_D$ is a delay used to match the directional signal with the delay caused to the side signal due to the decorrelation filtering operation, and γ is a scaling factor that can be used to adjust the proportion of the ambience component in the output signal. Delay $P_D$ is typically set to the average group delay of the decorrelation filters.

With all the operations presented above, a method was introduced that converts the input of two or more (typically three) microphones into five channels. If there is a need to create content also to the LFE channel, such content can be generated by low pass filtering one of the input channels.

The output channels can now (block 10K) be played with a multi-channel player, saved (e.g., to a memory or a file), compressed with a multi-channel coder, etc.

Signal Compression

Multi-channel synthesis provides several output channels, in the case of 5.1 channels there are six output channels. Coding all these channels requires a significant bit rate. However, before multi-channel synthesis, the representation is much more compact: there are two signals, mid and side, and directional information. Thus if there is a need for compression for example for transmission or storage purposes, it makes sense to use the representation which precedes multi-channel synthesis. An exemplary coding and synthesis process is illustrated in FIG. 11.

Figure 11:
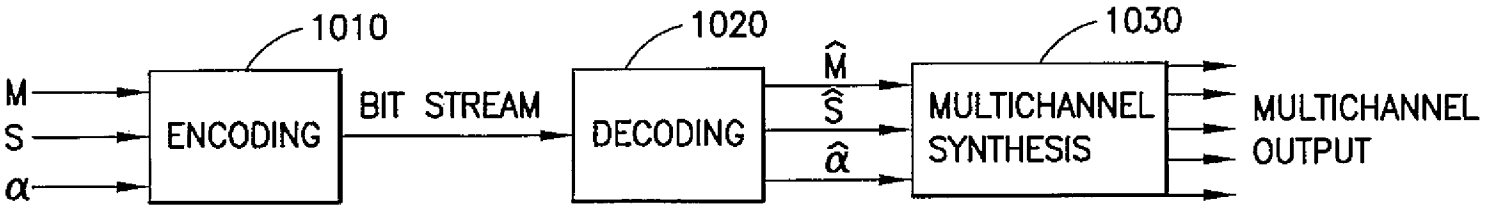
FIG. 11 is a block diagram of an exemplary coding and synthesis process.

In FIG. 11, M and S are time domain versions of the mid and side signals, and ∝ represents directional information, e.g., there are B directional parameters in every processing frame. In an exemplary embodiment, the M and S signals are available only after removing the delay differences. To make sure that delay differences between channels are removed correctly, the exact delay values are used in an exemplary embodiment when generating the M and S signals. In the synthesis side, the delay value is not equally critical (as the delay value signal is used for analyzing sound source directions) and small modification in the delay value can be accepted. Thus, even though delay value might be modified, M and S signals should not be modified in subsequent processing steps. However, it should be noted that mid and side signals are usually encoded with an audio encoder (e.g., MP3, motion picture experts group audio layer 3, AAC, advanced audio coding) between the sender and receiver when the files are either stored to a medium or transmitted over a network. The audio encoding-decoding process usually modifies the signals a little (i.e., is lossy), unless lossless codecs are used.

Encoding 1010 can be performed for example such that mid and side signals are both coded using a good quality mono encoder. The directional parameters can be directly quantized with suitable resolution. The encoding 1010 creates a bit stream containing the encoded M, S, and $\propto$. In decoding 1020, all the signals are decoded from the bit stream, resulting in output signals $\hat{M}$, $\hat{S}$ and $\hat{\propto}$. For multi-channel synthesis 1030, mid and side signals are transformed back into frequency domain representations.

Example Use Case

As an example use case, a player is introduced with multiple output types. Assume that a user has captured video with his mobile device together with audio, which has been captured with, e.g., three microphones. Video is compressed using conventional video coding techniques. The audio is processed to mid/side representations, and these two signals together with directional information are compressed as described in signal compression section above.

The user can now enjoy the spatial sound in two different exemplary situations:

1) Mobile use—The user watches the video he/she recorded and listens to corresponding audio using headphones. The player recognizes that headphones are used and automatically generates a binaural output signal, e.g., in accordance with the techniques presented above.

2) Home theatre use—The user connects his/her mobile device to a home theatre using, for example, an HDMI (high definition multimedia interface) connection or a wireless connection. Again, the player recognizes that now there are more output channels available, and automatically generates 5.1 channel output (or other number of channels depending on the loudspeaker setup).

Regarding copying to other devices, the user may also want to provide a copy of the recording to his friends who do not have a similar advanced player as in his device. In this case, when initiating the copying process, the device may ask which kind of audio track user wants to attach to the video and attach only one of the two-channel or the multi-channel audio output signals to the video. Alternatively, some file formats allow multiple audio tracks, in which case all alternative (i.e., two-channel or multi-channel, where multi-channel is greater than two channels) audio track types can be included in a single file. As a further example, the device could store two separate files, such that one file contains the two-channel output signals and another file contains the multi-channel output signals.

Example System and Method

Figure 12:
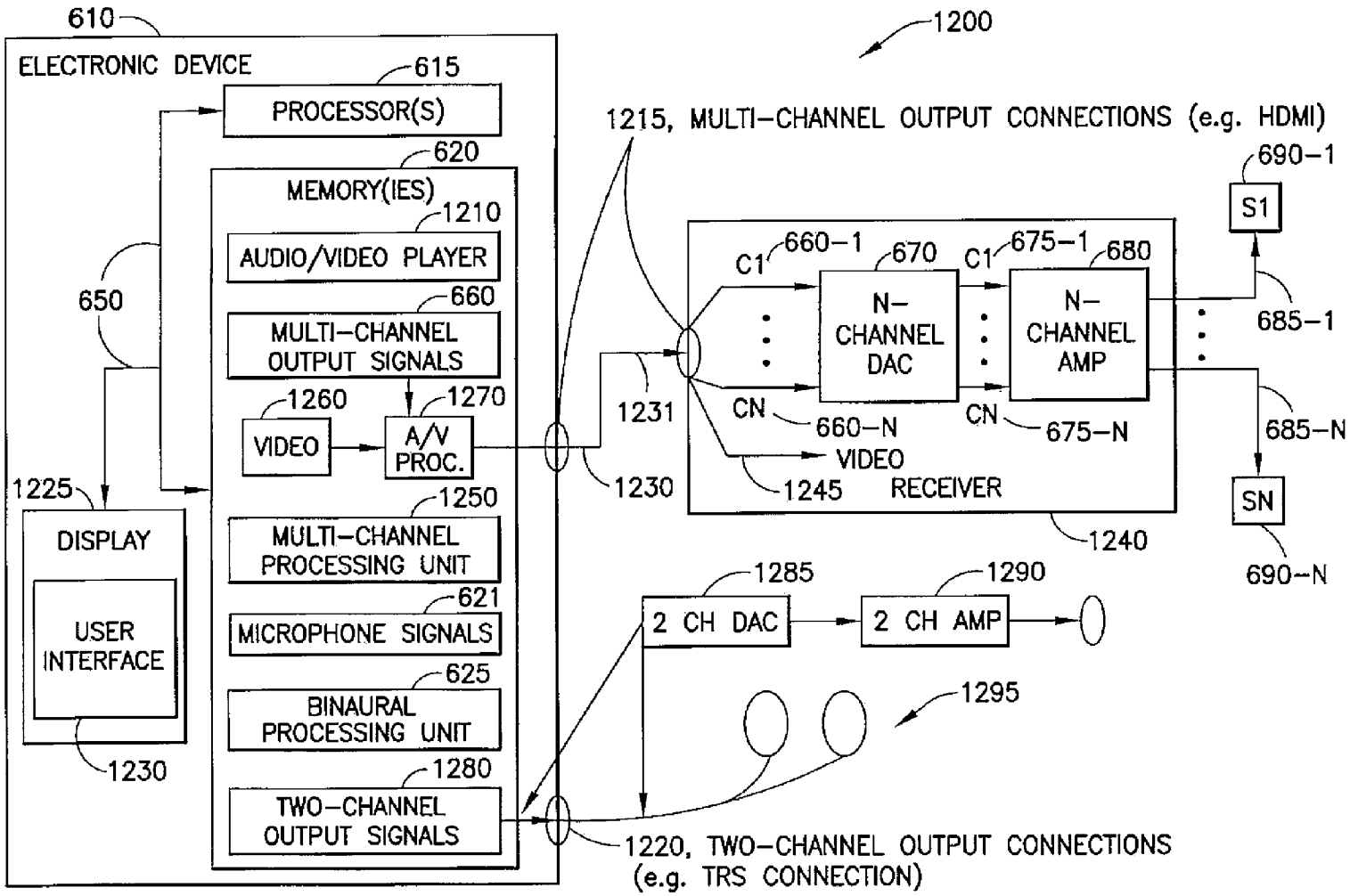
FIG. 12 is a block diagram of a system for synthesizing binaural signals and corresponding two-channel audio output signals and/or synthesizing multi-channel audio output signals from multiple recorded microphone signals.

An example system is shown in FIG. 12. This system 1200 uses some of the components from the system of FIG. 6, and those components will not be described again in this section. The system 1200 includes an electronic device 610. In this example, the electronic device 610 includes a display 1225 that has a user interface 1230. The one or more memories 620 in this example further include an audio/video player 1201, a video 1260, an audio/video processing (proc.) unit (1270), a multi-channel processing unit 1250, and two-channel output signals 1280. The two-channel (2 Ch) DAC 1285 and the two-channel amplifier (amp) 1290 could be internal to the electronic device 610 or external to the electronic device 610. Therefore, the two-channel output connection 1220 could be, e.g., an analog two-channel connection such as a TRS (tip, ring, sleeve) (female) connection (shown connected to earbuds 1295) or a digital connection (e.g., USB, universal serial bus, or two-channel digital connector such as an optical connector). In this example, the N-channel DAC 670 and N-channel amp 680 are housed in a receiver 1240. The receiver 1240 typically separates the signals received via the multi-channel output connections 1215 into their component parts, such as the CN channels 660 of digital audio in this example and the video 1245. Typically, this separation is performed by a processor (not shown in this figure) in the receiver 1240.

There are also multi-channel output connection 1215, such as HDMI (high definition multimedia interface), connected using a cable 1230 (e.g., HDMI cable). Another example of connection 1215 would be an optical connection (e.g., S/PDIF, Sony/Philips Digital Interconnect Format) using an optical fiber 1230, although typical optical connections only handle audio and not video.

The audio/video player 1210 is an application (e.g., computer-readable code) that is executed by the one or more processors 615. The audio/video player 1210 allows audio or video or both to be played by the electronic device 610. The audio/video player 1210 also allows the user to select whether one or both of two-channel output audio signals or multi-channel output audio signals should be put in an A/V file (or bitstream) 1231.

The multi-channel processing unit 1250 processes recorded audio in microphone signals 621 to create the multi-channel output audio signals 660. That is, in this example, the multi-channel processing unit 1250 performs the actions in, e.g., FIG. 10. The binaural processing unit 625 processes recorded audio in microphone signals 621 to create the two-channel output audio signals 1280. For instance, the binaural processing unit 625 could perform, e.g., the actions in FIGS. 2-5 above. It is noted in this example that the division into the two units 1250, 625 is merely exemplary, and these may be further subdivided or incorporated into the audio/video player 1210. The units 1250, 625 are computer-readable code that is executed by the one or more processor 615 and these are under control in this example of the audio video player.

It is noted that the microphone signals 621 may be recorded by microphones in the electronic device 610, recorded by microphones external to the electronic device 621, or received from another electronic device 610, such as via a wired or wireless network interface 630.

Figure 14:
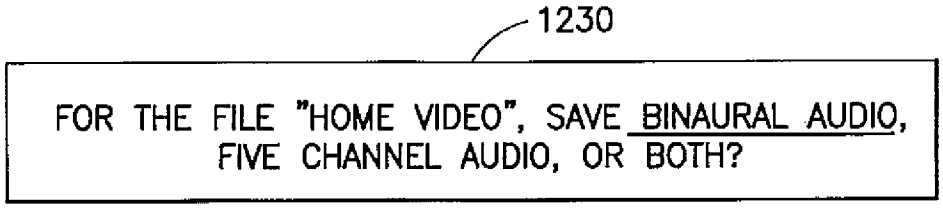
FIG. 14 is an example of a user interface to allow a user to select whether one or both of two-channel or multi-channel audio should be output.
Figure 13:
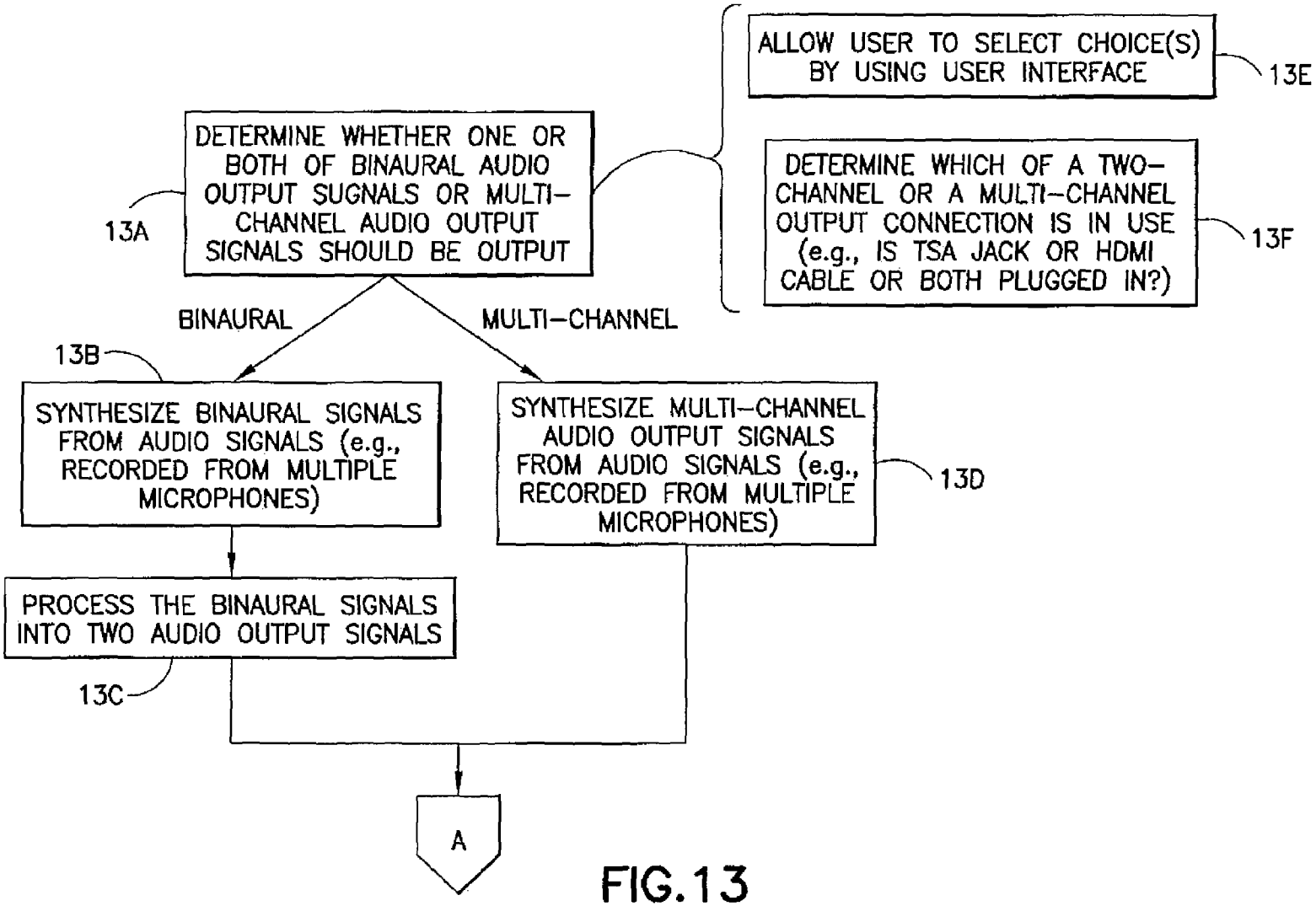
FIG. 13 is a block diagram of a flowchart for synthesizing binaural signals and corresponding two-channel audio output signals and/or synthesizing multi-channel audio output signals from multiple recorded microphone signals.
Figure 13:
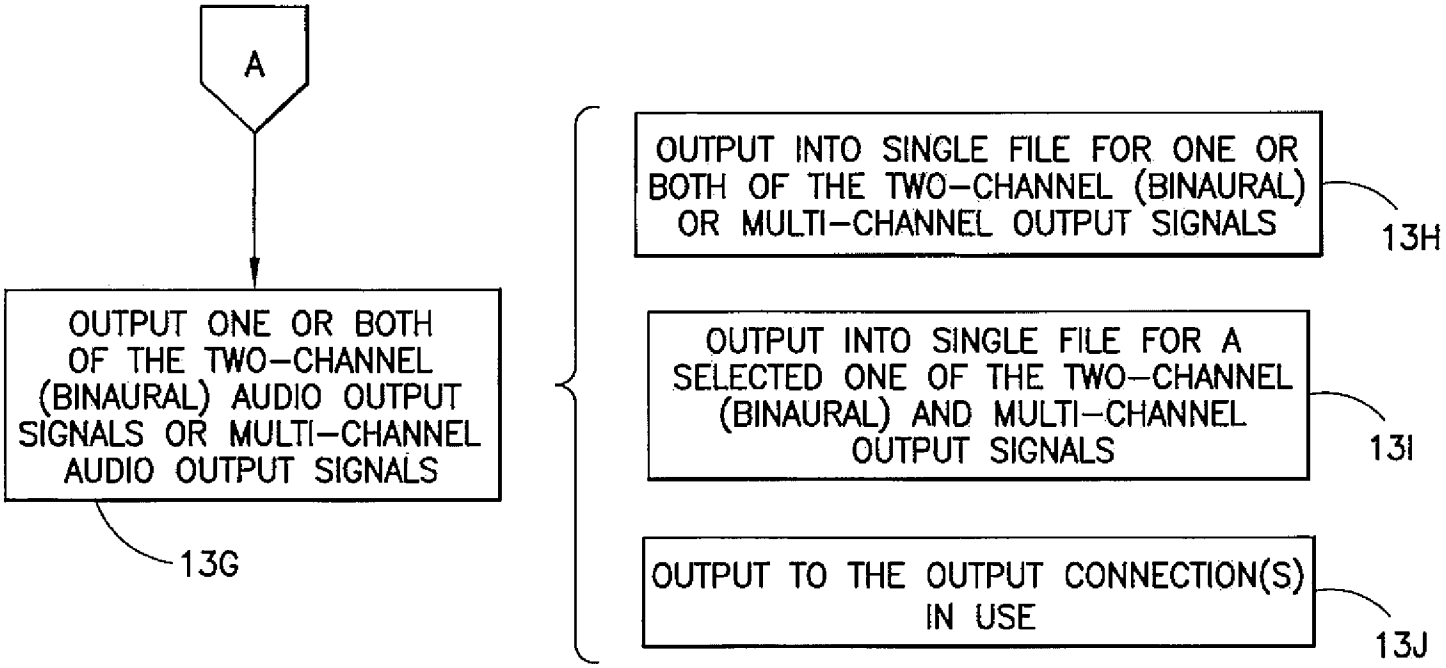

Additional detail about the system 1200 is described in relation to FIGS. 13 and 14. FIG. 13 is a block diagram of a flowchart for synthesizing binaural signals and corresponding two-channel audio output signals and/or synthesizing multi-channel audio output signals from multiple recorded microphone signals. FIG. 13 describes, e.g., the exemplary use cases provided above.

In block 13A, the electronic device 610 determines whether one or both of binaural audio output signals or multi-channel audio output signals should be output. For instance, a user could be allowed to select choice(s) by using user interface 1230 (block 13E). In more detail, the audio/video player could present the text shown in FIG. 14 to a user via the user interface 1230, such as a touch screen. In this example, the user can select "binaural audio" (currently underlined), "five channel audio", or "both" using his or her finger, such as by sliding a finger between the different options (whereupon each option would be highlighted by underlining the option) and then a selection is made when the user removes the finger. The "two channel audio" in this example would be binaural audio. FIG. 14 shows one non-limiting option and many others may be performed.

As another example of block 13A, in block 13F of FIG. 13, the electronic device 610 (e.g., under control of the audio/video player 1210) determines which of a two-channel or a multi-channel output connection is in use (e.g., which of the TSA jack or the HDMI cable, respectively, or both is plugged in). This action may be performed through known techniques.

If the determination is that binaural audio output is selected, blocks 13B and 13C are performed. In block 13B, binaural signals are synthesized from audio signals 621 recorded from multiple microphones. In block 13C, the electronic device 610 processes the binaural signals into two audio output signals 1280 (e.g., containing binaural audio output). For instance, blocks 13A and 13B could be performed by the binaural processing unit 625 (e.g., under control of the audio/video player 1210).

If the determination is that multi-channel audio output is selected, block 13D is performed. In block 13D, the electronic device 610 synthesizes multi-channel audio output signals 660 from audio signals 621 recorded from multiple microphones. For instance, block 13D could be performed by the multi-channel processing unit 1250 (e.g., under control of the audio/video player 1210). It is noted that it would be unlikely that both the TSA jack and the HDMI cable would be plugged in at one time, and thus the likely scenario is that only 13B/13C or only 13D would be performed at one time (and in 13G, only the corresponding one of the audio output signals would be output). However, it is possible for 13B/13C and 13D to both be performed (e.g., both the TSA jack and the HDMI cable would be plugged in at one time) and in block 13G, both the resultant audio output signals would be output.

In block 13G, the electronic device 610 (e.g., under control of the audio/video player 1210) outputs one or both of the two-channel audio output signals 1280 or multi-channel audio output signals 660. It is noted that the electronic device 610 may output an A/V file (or stream) 1231 containing the multi-channel output signals 660. Block 13G may be performed in numerous ways, of which three exemplary ways are outlined in blocks 13H, 13I, and 137.

In block 13H, one or both of the two- or multi-channel output signals 1280, 660 are output into a single (audio or audio and video) file 1231. In block 13I, a selected one of the two- and multi-channel output signals are output into single (audio or audio and video) file 1231. That is, the two-channel output signals 1280 are output into a single file 1231, or the multi-channel output signals 660 are output into a single file 1231. In block 13J, one or both of the two- or multi-channel output signals 1280, 660 are output to the output connection(s) 1220, 1215 in use.

Alternative Implementations

Above an exemplary implementation for generating 5.1 signals from a three-microphone input was presented. However, there are several possibilities for alternative implementations. A few exemplary possibilities are as follows.

The algorithms presented above are not especially complex, but if desired it is possible to submit three (or more) signals first to a separate computation unit which then performs the actual processing.

It is possible to make the recordings and perform the actual processing in different locations. For instance, three independent devices with one microphone can be used which then transmit their respective signals to a separate processing unit (e.g., server), which then performs the actual conversion to multi-channel signals.

It is possible to create the multi-channel signal using only directional information, i.e., the side signal is not used at all. Alternatively, it is possible to create a multichannel signal using only the ambiance component, which might be useful if the target is to create a certain atmosphere without any specific directional information.

Numerous different panning methods can be used instead of one presented in equation (25).

There many alternative implementations for gain preprocessing in connection of mid signal processing.

In equation (14), it is possible to use individual delay and scaling parameters for every channel.

Many other output formats than 5.1 can be used. In the other output formats, the panning and channel decorrelation equations have to be modified accordingly.

Alternative Implementations with More or Fewer Microphones

Above, it has been assumed that there is always an input signal from three microphones available. However, there are possibilities to do similar implementations with different numbers of microphones. When there are more than three microphones, the extra microphones can be utilized to confirm the estimated sound source directions, i.e., the correlation can be computed between several microphone pairs. This will make the estimation of the sound source direction more reliable. When there are only two microphones, typically one on the left and one on the right side, only the left-right separation can be performed for the sound source direction. However, for example when microphone capture is combined with video recording, a good guess is that at least the most important sound sources are in the front and it may make sense to pan all the sound sources to the front. Thus, some kinds of spatial recordings can be performed also with only two microphones, but in most cases, the outcome may not exactly match the original recording situation. Nonetheless, two-microphone capture can be considered as a special case of the instant invention.

Multi-Microphone Surround Audio Capture with Three Microphones and Stereo Channels, and Stereo, Binaural, or Multi-Channel Playback Thereof What has been described above includes techniques for spatial audio capture, which use microphone setups with a small number of microphones. Processing and playback for both binaural (headphone surround) and for multichannel (e.g., 5.1) audio were described. Both of these inventions use a two-channel mid (M) and side (S) audio representation, which is created from the microphone inputs. Both inventions also describe how the two-channel audio representation can be rendered to different listening equipment, headphones for binaural signals and 5.1 surround for multichannel signals.

It is desirable to give the user the possibility to choose a rendering of audio that best suits his or her current equipment. That is, if the user wants to listen to the audio over headphones, then the two-channel representation is rendered to binaural audio in real-time during playback according to the above techniques. Equally, if the user wants to use his or her 5.1 setup to listen to the audio, the two-channel representation is rendered to 5.1 channels in real-time during playback according to the above techniques. Also, other audio equipment setups are possible.

The two channel mid (M) and side (S) representation is not backwards compatible, i.e., the representation is not a left/right-stereo representation of audio. Instead, the two channels are the direct and ambient components of the audio. Therefore, without further processing, the two-channel mid/side representation cannot be played back using loudspeakers or headphones.

The Mid/Side representation is created from, e.g., three microphone inputs in the techniques presented above. Two of the microphones, microphones 2 and 3 (see FIG. 1) can be thought of being a right and a left microphone respectively. The third microphone (microphone 1 in FIG. 1) would then be a "rear" microphone. The left (L) and right (R) microphone signals can be played back over loudspeakers and headphones, with little or no processing. While the microphone placement used in above, e.g., in FIG. 1, might not create the best stereo, the output from the microphone placement is still quite useable. The original left and right microphone signals can be played back over headphones and loudspeakers but neither of these signals can be directly be used to create multichannel (e.g., 5.1) or headphone surround (binaural) audio.

The exemplary embodiments herein allow the original left and right microphones to be used, e.g., as stereo output, but also provide techniques for processing these signals into binaural or multi-channel signals. For instance, the following two non-limiting, exemplary cases are described:

Case 1: The original left (L) and right (R) microphone signals are used as a stereo signal for backwards compatibility. Techniques presented below explain how these (L) and (R) microphone signals can be used to create binaural and multi-channel (e.g., 5.1) signals with help of some directional information.

Case 2: High Quality (HQ) left ($\hat{L}$) and right ($\hat{R}$) signals are created and used as a stereo signal for backwards compatibility. Techniques presented below explain how these HQ ($\hat{L}$) and ($\hat{R}$) signals can be used to create binaural and multi-channel (e.g., 5.1) signals with help of some directional information.

Exemplary Case 1

Figure 15:
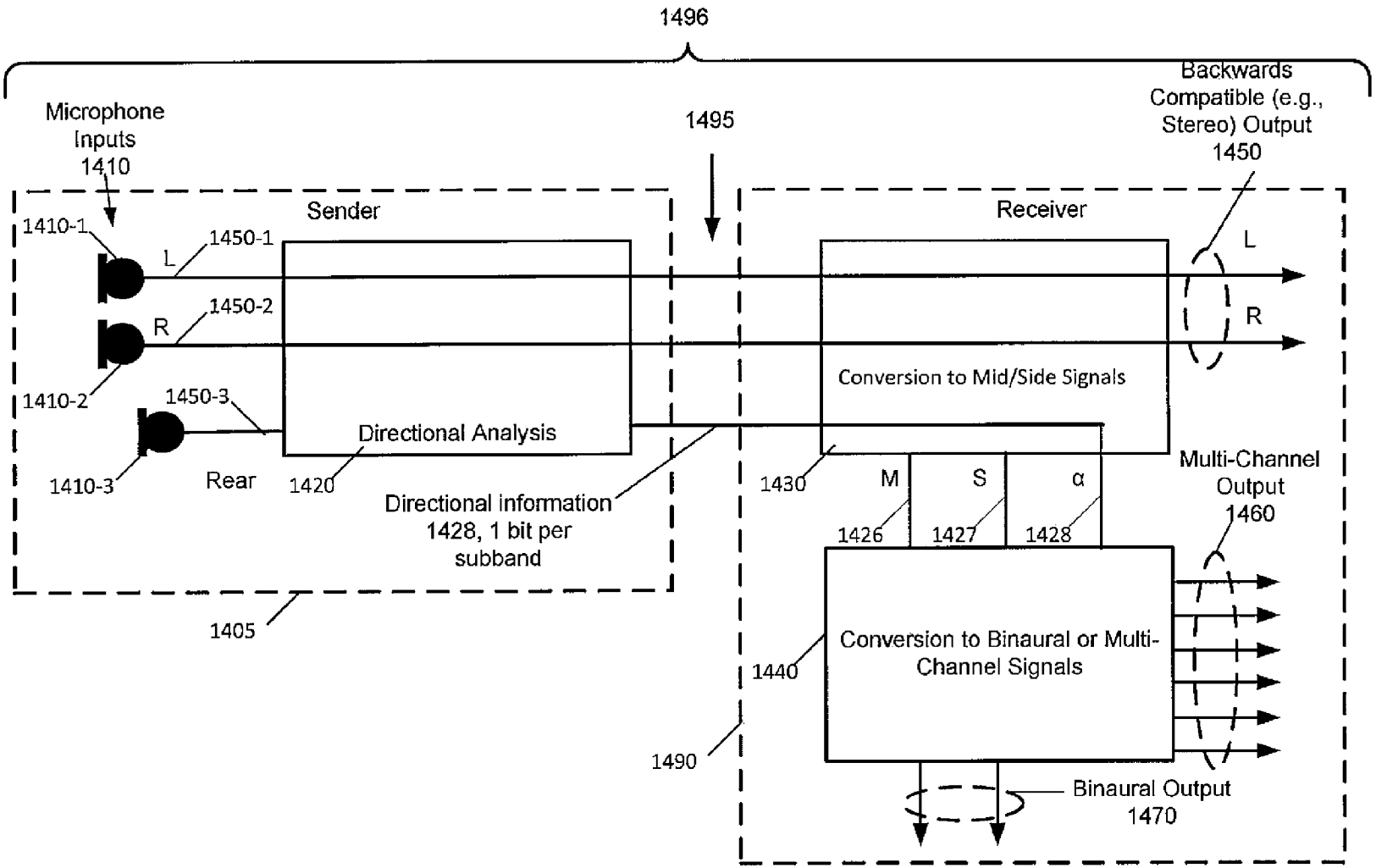
FIG. 15 is a block diagram of a system for backwards compatible multi-microphone surround audio capture with three microphones and stereo channels, and stereo, binaural, or multi-channel playback thereof.

Referring to FIG. 15, a block diagram is shown of a system for backwards compatible multi-microphone surround audio capture with three microphones and stereo channels, and stereo, binaural, or multi-channel playback thereof. The block diagram may also be considered a flowchart, as many of the blocks represent operations performed on signals.

A sender 1405 includes three microphone inputs 1410-1 (referred to herein as a left, L microphone), 1410-2 (referred to herein as a right, R microphone), and 1410-3 (referred to herein as a rear microphone). Exemplary microphone placement is shown in FIG. 1 and further shown for mobile devices in FIGS. 17, 18A, and 18B. Each microphone 1410 produces a corresponding signal 1450. The sender 1405 includes directional analysis functionality 1420, which passes the left 1450-1 and right 1450-2 signals to a receiver, and performs a directional analysis to create directional information 1428. In this example, the sender 1405 sends the signals 1450-1, 1450-2, and 1428 via a network 1495, which could be a wired network (e.g., HDMI, USB or other serial interface, Ethernet) or a wireless network (e.g., Bluetooth or cellular). These signals can also be stored to a local medium (e.g., a memory such as a hard disk). Also, the signals can be coded with MP3, AAC and the like, prior to or while being stored or transmitted over a network.

The receiver 1490 includes conversion to mid/side signals functionality 1430, which creates mid (M) signal 1426, side signal 1427, and directional information α 1428. The stereo output 1450 is backward compatible in the sense that this output can be played on two-channel systems such as headphones or stereo systems. The receiver 1490 includes conversion to binaural or multi-channel signals functionality 1440, the output of which is binaural output 1470 or multi-channel output 1460 (or both, although it is an unlikely scenario for a user to output both outputs 1470, 1460).

In this example, the sender 1405 is the software or device that records the three microphone signal and stores the signal to a file (not shown in FIG. 15) or sends the signal (or file) over a network. The receiver 1490 is the software or device that reads the file or receives the signal over a network and then plays the signal to a user. In audio coding terms, the sender is the microphones and encoder and receiver is the decoder and loudspeakers/headphones. For instance, the sender 1405 could be the electronic device 710 shown in FIG. 7 (or the encoding 1010 in FIG. 11), and the receiver 1450 could be the electronic device 705 in FIG. 7 (or the decoding 1020 and multichannel synthesis 1030 in FIG. 11).

In the directional analysis functionality 1420, the left (L) and Right (R) microphone signals are directly used as the output and transmitted to the receiver 1450. In the directional analysis functionality 1420, directional information 1428 about whether the dominant source in a frequency band was coming from behind or in front of the three microphones 1410 is also added to the transmission. The directional information takes only one bit for each frequency band. In the synthesis part (e.g., conversion to mid/side signal functionality 1430 and conversion to binaural or multi-channel signals functionality 1440), if a stereo signal is desired then the L and R signals 1450-1, 1450-2, respectively, can be used directly. If a multichannel (e.g., 5.1) or a binaural signal is desired, then the L and R signals are converted first to mid (M) 1426 and side (S) 1427 signals according to the techniques presented above.

In this case, the information about whether the dominant source in that frequency band is coming from behind or in front of the three microphones is now taken from the directional information. That is, the directional analysis functionality 1420 performs equations (1) to (12) above, but then assigns directional information 1428 based on the sign in equation 12 as follows:

$$\alpha_b = \begin{cases} \dot{\alpha}_b & \text{1 bit side information} = 1 \\ -\dot{\alpha}_b & \text{1 bit side information} = 0 \end{cases} \tag{35}$$

That is, the directional information 1428 is calculated in the sender 1405 based on equation 12. If alpha is positive, the directional information is "1", otherwise "0". It is noted that is it is possible to relate this to a configuration of the device/location of the microphones. For instance, if a microphone is really on the backside of a device, then "1" (or "0") could indicate the direction is toward the "front" of the device. The directional information 1428 can be added directly, e.g., to a bit stream or as a watermark. The directional information 1428 is sent to the receiver as one bit per subband in, e.g., the bit stream. For example, if there are 30 subbands per frame of audio, then the directional information is 30 bits for each frame of audio. The corresponding bit for each subband is set to one or zero according to the directional information, as previously described.

The conversion to mid/side signals functionality 1430 performs conversion to a mid (M) signal 1426 and a side (S) signal 1427, using equation 35 and equations (13) and (14) above.

After conversion to (M) and (S) signals, binaural or multichannel audio can be rendered (block 1440) according to the above equations. For instance, to generate binaural output, the equations (15) to (20) (e.g., along with block 5E of FIG. 5) may be performed. To generate multi-channel signals, equations (24) to (34) may be used.

It should be noted that sender 1405 and receiver 1490 can be combined into a single device 1496 that could perform the functions described above. Furthermore, the sender and receiver could be further subdivided, such as the receiver 1490 be subdivided into a portion that performs functionality 1430, and the output 1450 and signals 1426, 1427, and 1428 could be communicated to another portion that outputs one of the outputs 1450, 1460, or 1470.

Exemplary Case 2

Figure 16:
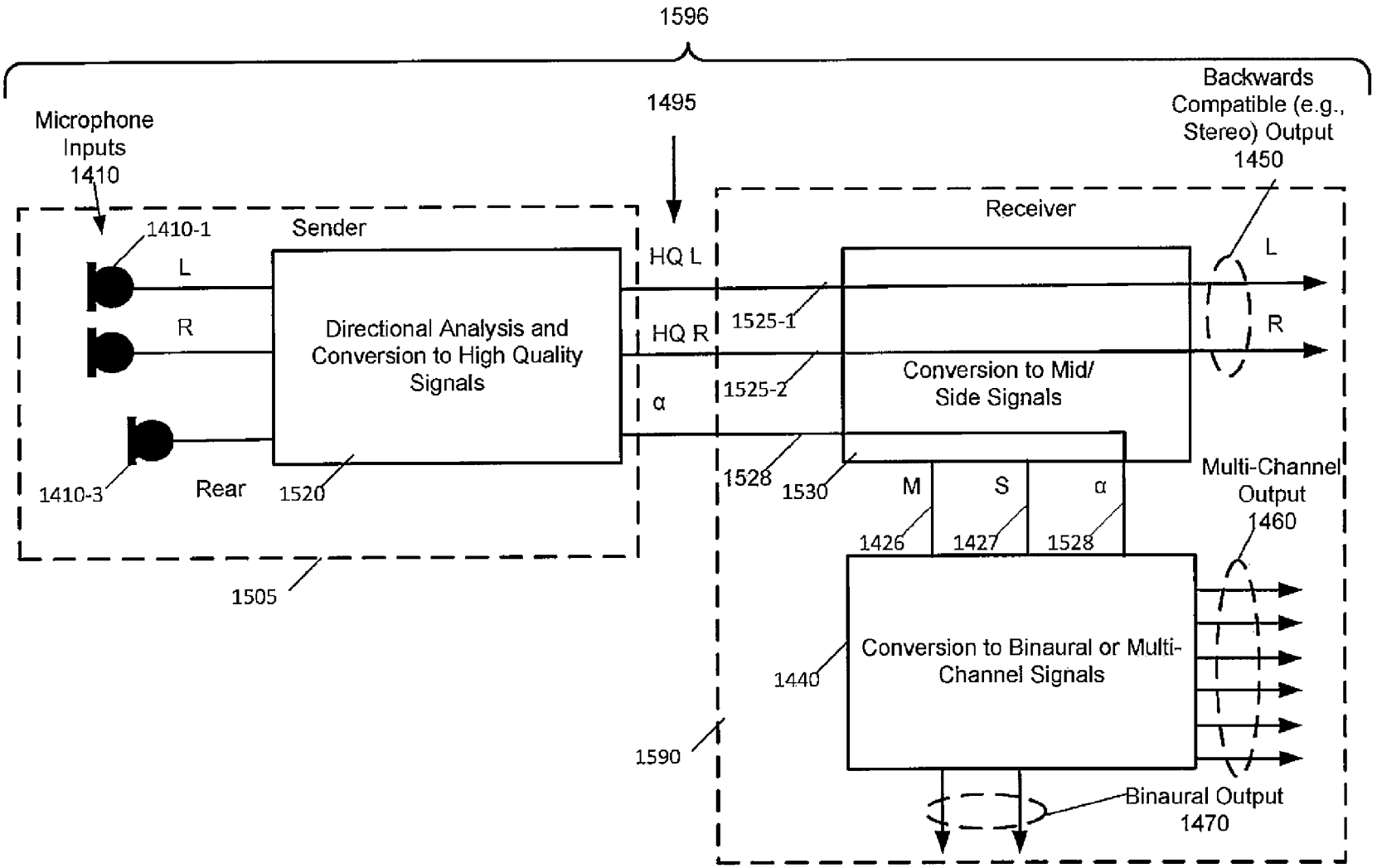
FIG. 16 is a block diagram of another system for backwards compatible multi-microphone surround audio capture with three microphones and stereo channels, and stereo, binaural, or multi-channel playback thereof.

Referring to FIG. 16, a block diagram is shown of a system for backwards compatible multi-microphone surround audio capture with three microphones and stereo channels, and stereo, binaural, or multi-channel playback thereof. The block diagram may also be considered a flowchart, as many of the blocks represent operations performed on signals. Many of the elements in FIG. 16 have been described in reference to FIG. 15, so only differences are described herein. The sender 1505 includes directional analysis and conversion to high quality signals functionality 1520, which outputs high quality (HQ) ($\hat{L}$) and ($\hat{R}$) signals 1525-1 and 1525-2, respectively, and direction angles ($\alpha$) 1528. The conversion to mid and side signals functionality 1530 operates, using direction angles 1528, on the signals 1525-1 and 1525-2 to create the mid signal 1426 and the side signal 1427, as explained below. The direction angles 1528 passes through the functionality 1530.

In the analysis part (functionality 1520), a HQ ($\hat{L}$) and ($\hat{R}$) signal 1525 is created. This can be performed as follows: the techniques presented above are followed until equations (12), (13) and (14), where the direction angle $\alpha_b$ of the dominant source, the mid (M) and the side (S) signals are formed. The HQ ($\hat{L}$) and ($\hat{R}$) signals are created by panning the mid (M) signal to the left and right channels with help of the direction angle $\alpha$ and adding to the panned left and right channels a decorrelated (S) signal:

$$\hat{L}_f = \mathrm{pan}_L(\alpha_f)\cdot M + \mathrm{decorr}_{L,f}(S),$$

$$\hat{R}_f = \mathrm{pan}_R(\alpha_f)\cdot M + \mathrm{decorr}_{R,f}(S) \tag{36}$$

where $\alpha_f = \alpha_b$ if $f$ belongs to the frequency band b. As an example, there may be 513 unique frequency indexes after a 1024 samples long FFT (fast Fourier transform). Thus, $f$ runs from 0 to 512. Again as an example, frequency indexes 0, 1, 2, 3, 4, 5 might belong to frequency band number 1, indexes 6 . . . 10 belong to frequency band number 2, etc., until, e.g., indexes 200 . . . 512 might belong to the last band.

Panning using $\mathrm{pan}_L(\alpha_f)$ and $\mathrm{pan}_R(\alpha_f)$ can easily be achieved using for example V. Pulkki, "Virtual Sound Source Positioning Using Vector Base Amplitude Panning," J. Audio Eng. Soc., vol. 45, pp. 456-466 (1997 June) or A. D. Blumlein, U.K. patent 394,325, 1931, reprinted in Stereophonic Techniques (Audio Engineering Society, New York, 1986). The panning function is a simple real-valued multiplier that depends on the input angle, and the input angle is relative to the position of the microphones. That is, the output of the panning function is simply a scalar number. The panning function is always greater than or equal to zero and produces an output of a panning factor (e.g., a scalar number). The panning factor is fixed for a frequency band, however, the decorrelation is different for each frequency bin in a frequency band. It may also, in an exemplary embodiment, be wise to change the panning a bit for the frequency bins that are near the frequency band border, so that the change at the frequency band border would not be so abrupt. The panning function gets as its input only the directional information, and the panning function is not a function of the left or right signals. Typical examples of values for the panning functions are as follows. For $\mathrm{pan}_L(\alpha_f)=0$ and $\mathrm{pan}_R(\alpha_f)=1$, the signal is panned to the direction of the right speaker. For $\mathrm{pan}_L(\alpha_f)=0$ and $\mathrm{pan}_R(\alpha_f)=1$, the signal is panned to the direction of the left speaker. For $\mathrm{pan}_L(\alpha_f)=0$ and $\mathrm{pan}_R(\alpha_f)=1/2$, the signal is panned to the direction between the left and right speakers. For $\mathrm{pan}_L(\alpha_f)<1/2$ and $\mathrm{pan}_R(\alpha_f)>1/2$, the signal is panned closer to the right speaker than to the left speaker.

A decorrelation function is a function that rotates the angle of the complex representation of the signal in frequency domain (where c is a channel, e.g., L or R, and where $x_{c,f}$ is an angle of rotation).

$$\mathrm{decorr}_{c,f}(be^{i\beta}) = be^{i(\beta + x_{c,f})}. \tag{37}$$

The decorrelation function is invertible and linear:

$$\mathrm{decorr}_{c,f}^{-1}(\mathrm{decorr}_{c,f}(S)) = S, \tag{38}$$

$$\mathrm{decorr}_{c,f}(a\cdot S + b\cdot M) = a\cdot\mathrm{decorr}_{c,f}(S) + b\cdot\mathrm{decorr}_{c,f}(M), \tag{39}$$

where $\mathrm{decorr}_{c,f}^{-1}$ is the inverse of the decorrelation function. The amount of rotation $x_{c,f}$ is chosen to be dependent on channel (c) so that decorrelation for left and right channels is different because the amount of rotation chosen for each channel is different. Alternatively, one of the channels can be left unchanged and the other channel decorrelated. Decorrelation for different frequency bins ($f$) is usually different, however for one channel the decorrelation for the same bin is constant over time.

The HQ ($\hat{L}$) and ($\hat{R}$) signals 1524-1 and 1525-2, respectively, are transmitted to the receiver 1450 along with the direction angle $\alpha_b$ 1528. The receiver 1590 can now choose to use HQ ($\hat{L}$) and ($\hat{R}$) signals 1525-1 and 1525-2 when backwards compatibility is required. Alternatively, it is still possible to convert the HQ ($\hat{L}$) and ($\hat{R}$) signals to multichannel (e.g., 5.1) and binaural signals in the receiver. Consider the following (Equation 40):

$$\begin{aligned}
&\hat{L} - decorr_L\left(decorr_R^{-1}(\hat{R})\right) = \\
&\quad \hat{L} - decorr_L(decorr_R^{-1}(pan_R(\alpha)\cdot M + decorr_R(S))) = \\
&\quad \hat{L} - decorr_L(decorr_R^{-1}(pan_R(\alpha)\cdot M) + S) = \\
&\quad \hat{L} - decorr_L(decorr_R^{-1}(pan_R(\alpha)))\cdot M - decorr_L(S) = \\
&\quad pan_L(\alpha)\cdot M + decorr_L(S) - decorr_L(decorr_R^{-1}(pan_R(\alpha)))\cdot M - \\
&\quad decorr_L(S) = M(pan_L(\alpha) - decorr_L(decorr_R^{-1}(pan_R(\alpha))))
\end{aligned}$$

For the sake of simplicity frequency bin indexes were left out from these equations. That is, In all the equations 35-43, "M","S","L" and "R" should have $f$ as a subscript.

From the previous, one can determine:

$$M = \frac{\hat{L} - decorr_L\left(decorr_R^{-1}(\hat{R})\right)}{pan_L(\alpha) - decorr_L(decorr_R^{-1}(pan_R(\alpha)))} \tag{41}$$

and since the panning functions are known because the angle $\alpha_b$ was transmitted as directional information, M can be readily solved.

Now that the mid signal is known, the side signal can be solved as follows:

$$S=\mathrm{decorr}_L^{-1}(\hat{L}-\mathrm{pan}_L(\alpha)\cdot M). \quad (42)$$

The (M) and (S) signals can then be used to create, e.g., multi-channel (e.g., 5.1) or binaural signals as described above.

If the right channel portion of the side signal is left undecorrelated (i.e., unchanged), then Equation 36 becomes the following:

$$\hat{L}_f=\mathrm{pan}_L(\alpha_f)\cdot M+\mathrm{decorr}_{L,f}(S)$$

$$\hat{R}_f=\mathrm{pan}_R(\alpha_f)\cdot M+S$$

Equation 41 would be the following:

$$M=\frac{\hat{L}-decorr_L(\hat{R})}{pan_L(\alpha)-decorr_L(pan_R(\alpha))},$$

Equation 42 would be the following:

$$S=\hat{R}-\mathrm{pan}_R(\alpha)\cdot M.$$

If the left channel portion of the side signal is left undecorrelated (i.e., unchanged), then Equation 36 becomes the following:

$$\hat{L}_f=\mathrm{pan}_L(\alpha_f)\cdot M+S$$

$$\hat{R}_f=\mathrm{pan}_R(\alpha_f)\cdot M+\mathrm{decorr}_{R,f}(S)$$

Equation 41 would be the following:

$$M=\frac{\hat{R}-decorr_R(\hat{L})}{pan_R(\alpha)-decorr_R(pan_L(\alpha))},$$

Equation 42 would be the following:

$$S=\hat{L}-\mathrm{pan}_L(\alpha)\cdot M.$$

Equations 37 to 40 act as a mathematical proof that the system works. Equations 41 and 42 are the needed calculations on the receiver 1590 and are performed by functionality 1530. Equations 41 and 42 are performed for each frequency band in side S, mid M, left L and right R signals.

The sender 1505 and receiver 1590 may be combined into a single device 1596 or may be further subdivided.

Figure 17:
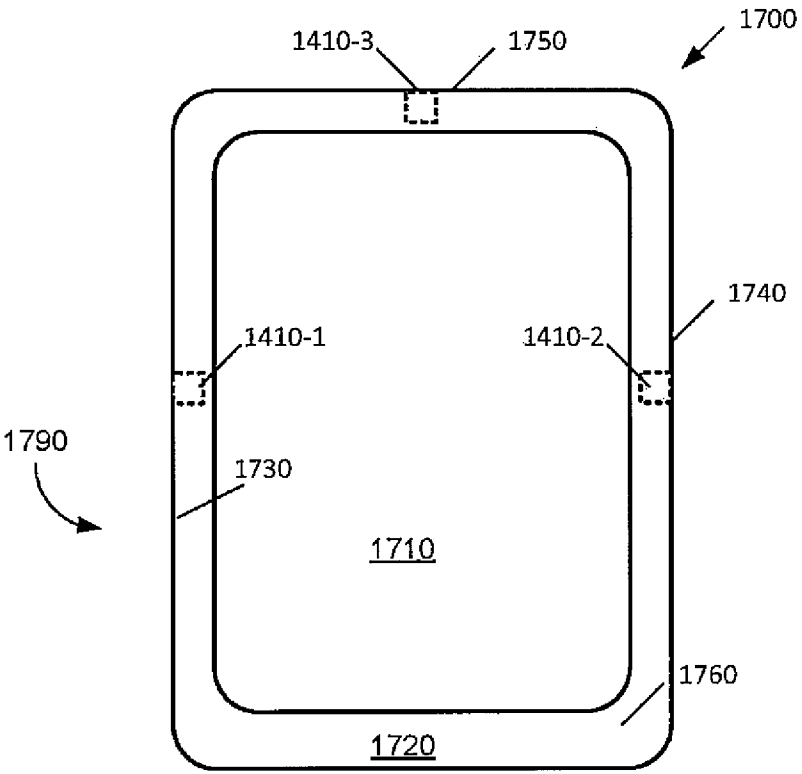
FIG. 17 is an example of a mobile device having microphones therein suitable for use as at least a sender.

Turning to FIG. 17, an example is shown of a mobile device 1700 having microphones therein suitable for use as at least a sender 1405/1505. In this example, the mobile device 1700 includes a case 1720 and a screen 1710. The left microphone 1410-1 is contained within the case 1720 and opens to the left side 1730 of the case 1720. The right microphone 1410-2 is contained within the case 1720 and opens to the right side 1740 of the case 1720. The "rear" microphone 1410-3 is contained within the case 1720 and opens to the top side 1750 of the case 1720. The rear microphone 1410-3 in this position should be able to distinguish between sound directions to the front side 1760 of the mobile device 1700 and the backside 1790 of the mobile device 1700.

Figure 18B:
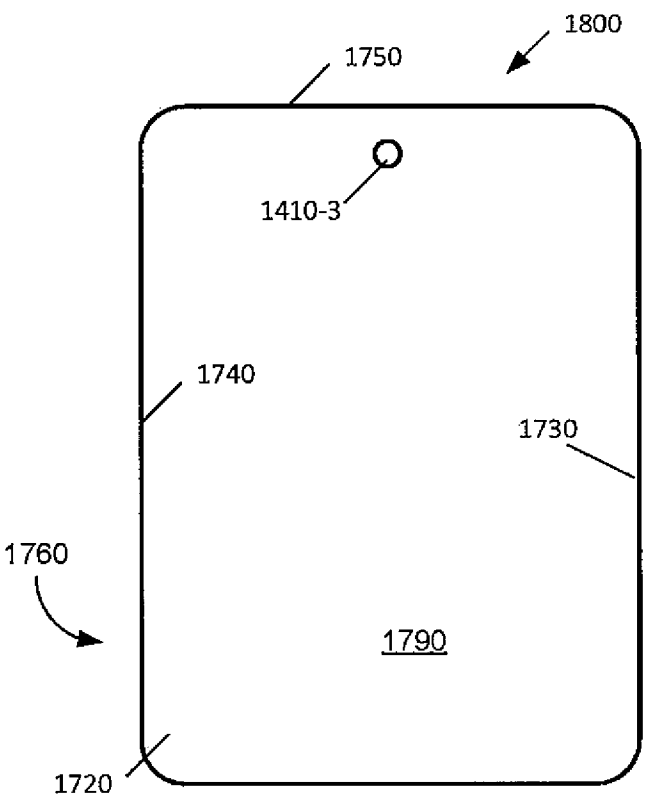
FIG. 18B is an example of a backside of a mobile device having microphones therein suitable for use as at least a sender.
Figure 18A:
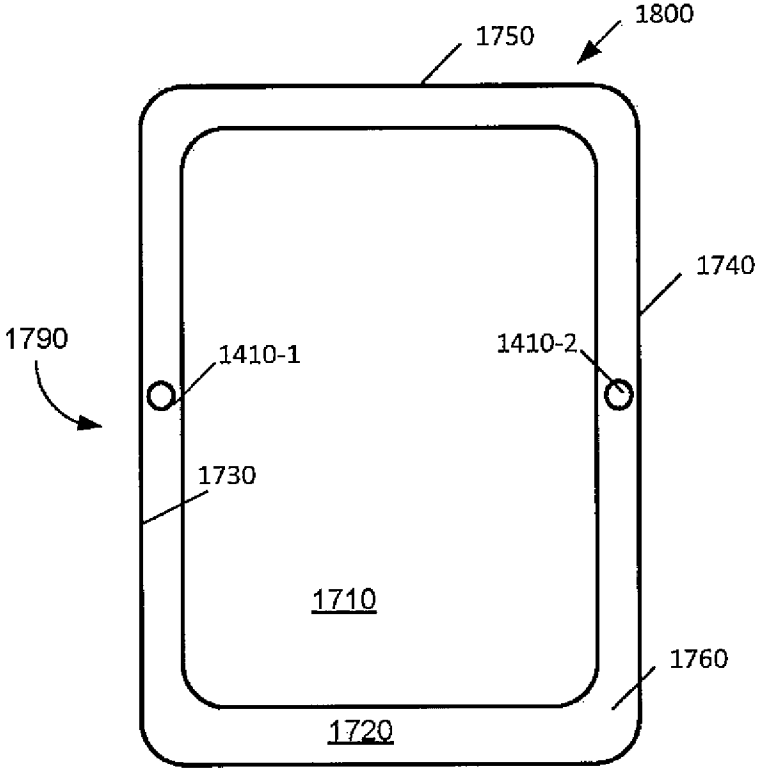
FIG. 18A is an example of a front side of a mobile device having microphones therein suitable for use as at least a sender.

FIG. 18A is an example of a front side 1760 of a mobile device having microphones therein suitable for use as at least a sender, and FIG. 18B is an example of a backside 1790 of a mobile device having microphones therein suitable for use as at least a sender. In this example, the left 1410-1 and right 1410-2 microphones open through the case 1720 to the front side 1760 of the case 1720, whereas the rear microphone 1410-3 opens to the backside 1790 of the case 1720.

Figure 19:
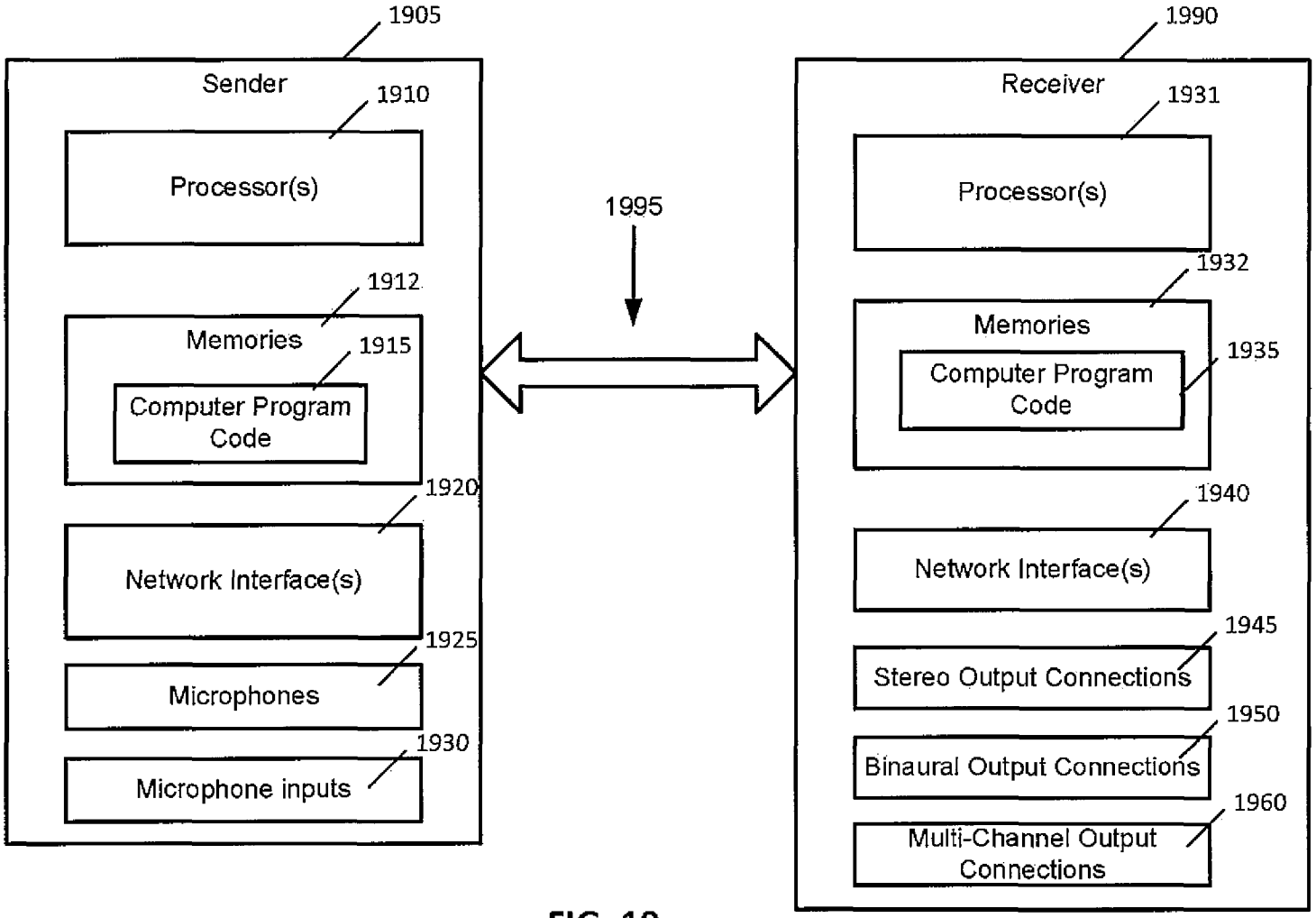
FIG. 19 is a block diagram of a system for backwards compatible multi-microphone surround audio capture with three microphones and stereo channels, and stereo, binaural, or multi-channel playback thereof.

Referring now to FIG. 19, a block diagram is shown of a system for backwards compatible multi-microphone surround audio capture with three microphones and stereo channels, and stereo, binaural, or multi-channel playback thereof. The system includes a sender 1905 (e.g., sender 1405/1505) and a receiver 1990 (e.g., receiver 1490/1590) interconnected through a wired or wireless network 1995. The sender includes one or more processors 1910, one or more memories 1912 including computer program code 1915, one or more network interfaces 1920, one or more microphones 1925, and one or more microphone inputs 1925. The receiver includes one or more processors 1931, one or more memories 1932 including computer program code 1935, one or more network interfaces 1940, stereo output connections 1945, binaural output connections 1950, and multi-channel output connections 1960.

The computer program code 1915 contains instructions suitable, in response to being executed by the one or more processors 1910, for causing the sender 1905 to perform at least the operations described above, e.g., in reference to functionality 1520. The computer program code 1935 contains instructions suitable, in response to being executed by the one or more processors 1931, for causing the receiver 1990 to perform at least the operations described above, e.g., in reference to functionality 1430/1530 and 1440.

The microphones 1925 may include zero to three (or more) microphones, and the microphone inputs may include zero to three (or more) microphone inputs, depending on implementation. For instance, two internal left and right microphones 1410-1 and 1410-2 could be used and one external microphone 1410-3 could be used.

The network 1995 could be a wired network (e.g., HDMI, USB or other serial interface, Ethernet) or a wireless network (e.g., Bluetooth or cellular) (or some combination thereof), and the network interfaces 1920 and 1940 may be suitable network interfaces for the corresponding network.

The stereo outputs 1945, binaural outputs 1950, and multi-channel outputs 1960 of the receiver may be any suitable output, such as two-channel or 5.1 (or more) channel RCA connections, HDMI connections, headphone connections, optical connections, and the like.

Without in any way limiting the scope, interpretation, or application of the claims appearing below, a technical effect of one or more of the example embodiments disclosed herein is to provide binaural signals, stereo signals, and/or multi-channel signals from a single set of microphone input signals. For instance, see FIG. 6, which shows the potential use of external microphones.

Embodiments of the present invention may be implemented in software, hardware, application logic or a combination of software, hardware and application logic. In an exemplary embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with examples of computers described and depicted. A computer-readable medium may comprise a computer-readable storage medium that may be any media or means that can contain or store the instructions for use by or in connection with an instruction execution system, apparatus, or device, such as a computer.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. A method, comprising, determining, using microphone signals corresponding to a left microphone signal from a left microphone and a right microphone signal from a right microphone and using at least one further microphone signal, directional information of the left and right microphone signals corresponding to a location of a sound source; outputting a first signal corresponding to the left microphone signal; outputting a second signal corresponding to the right microphone signal; and outputting a third signal corresponding to a sign of the determined directional information, wherein the sign is transmitted as a binary value that indicates the sound source coming from behind or in front of the left microphone and the right microphone.

2. The method according to claim 1, wherein the left and right signals are divided into frequency bands and the directional information is determined for each frequency band.

3. The method according to claim 2, wherein the determined directional information includes an alpha angle and the sign of the determined direction information is the sign of the alpha angle transmittable as a single bit of information for each frequency band.

4. The method according to claim 1, wherein at least one of the first signal and the second signal are coded using at least one of AMR-WB+, MP3, AAC and AAC+, and the first signal and the second signal produce a backwards compatible stereo signal.

5. The method according to claim 1, wherein the first signal, the second signal and the third signal are convertible to mid and side signals used to render at least one of binaural and multi-channel audio.

6. A method comprising, receiving, by a processor, a first signal corresponding to a left microphone signal from a left microphone, a second signal corresponding to a right microphone signal from a right microphone, and a third signal corresponding to a sign of directional information of the left and right microphone signals determined using at least one further microphone signal and corresponding to a location of a sound source, wherein the sign is transmitted as a binary value that indicates the sound source coming from behind or in front of the left microphone and the right microphone, wherein the processor generates an audio output signal dependent on the sign of the directional information.

7. The method according to claim 6, wherein the left and right signals are divided into frequency bands, and wherein the determined directional information includes an alpha angle having the sign received as a single bit of information for each frequency band determined based on the sound source coming from behind or in front of the left microphone and the right microphone.

8. The method according to claim 7, wherein an absolute value of the directional information angle alpha is determined for each frequency band based on at least the received left and right signals.

9. The method according to claim 6, wherein at least one of the first signal and the second signal are coded using at least one of AMR-WB+, MP3, AAC and AAC+, and further comprising producing a backwards compatible stereo signal from the first signal and the second signal.

10. The method according to claim 6, further comprising converting the first signal, the second signal and the third signal to mid and side signals used to render at least one of binaural and multi-channel audio.

11. A method, comprising, determining, using microphone signals corresponding to a left microphone signal from a left microphone and a right microphone signal from a right microphone and using at least one further microphone signal, directional information of the left and right microphone signals corresponding to a location of a sound source; converting the left microphone signal, the right microphone signal and the directional information into a high quality directional audio coding left microphone signal and a high quality directional audio coding right microphone signal; and outputting a first signal corresponding to the high quality directional audio coding left microphone signal; and outputting a second signal corresponding to the high quality directional audio coding right microphone signal.

12. The method according to claim 11, wherein the left microphone signal and right microphone signal are divided into frequency bands; and wherein the determined directional information includes an alpha angle for each frequency band determined based on the location of a sound source.

13. The method according to claim 12, further comprising outputting the angle alpha as a third signal corresponding to the determined directional information.

14. The method according to claim 13, wherein the first signal and the second signal are convertible using the alpha angle to mid and side signals used to render at least one of binaural and multi-channel audio.

15. The method according to claim 11, wherein at least one of the first signal and the second signal are coded using at least one of AMR-WB+, MP3, AAC and AAC+, and the first signal and the second signal produce a backwards compatible stereo signal.

16. A method comprising receiving, by a processor, a first signal corresponding to a high quality directional audio coding left microphone signal determined from a left microphone, and a second signal corresponding to a high quality directional audio coding right microphone signal determined from a right microphone, where the high quality directional audio coding left microphone signal and the high quality directional audio coding right microphone signal are based on directional information of left and right microphone signals determined using at least one further microphone signal and corresponding to a location of a sound source, wherein the processor generates an audio output signal dependent on the directional information.

17. The method according to claim 16, wherein the determined directional information includes an alpha angle determined based on the sound source direction; and further comprising receiving the alpha angle.

18. The method according to claim 17, further comprising converting using the angle alpha the first signal and the second signal to mid and side signals used to render at least one of binaural and multi-channel audio.

19. The method according to claim 16, further comprising producing a backwards compatible stereo signal from the first signal and the second signal.

20. The method according to claim 16; wherein at least one of the first signal and the second signal are coded using at least one of AMR-WB+, MP3, AAC and AAC+.

* * * * *